US010463556B2

(12) United States Patent
Tessmer

(10) Patent No.: US 10,463,556 B2
(45) Date of Patent: Nov. 5, 2019

(54) PATIENT MOBILITY SYSTEM WITH INTEGRATED AMBULATION DEVICE

(71) Applicant: Stryker Corporation, Kalamazoo, MI (US)

(72) Inventor: Brian J. Tessmer, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 16/033,608

(22) Filed: Jul. 12, 2018

(65) Prior Publication Data

US 2019/0015279 A1 Jan. 17, 2019

Related U.S. Application Data

(60) Provisional application No. 62/532,134, filed on Jul. 13, 2017.

(51) Int. Cl.

| | |
|---|---|
| ***A61H 3/04*** | (2006.01) |
| ***A61G 7/10*** | (2006.01) |
| ***A61G 7/05*** | (2006.01) |

(52) U.S. Cl.

CPC ..... *A61G 7/1046* (2013.01); *A61G 7/0508* (2016.11); *A61G 7/0518* (2016.11); (Continued)

(58) Field of Classification Search

CPC .. A61G 7/1046; A61G 7/0508; A61G 7/0518; A61G 7/1042; A61H 3/04

See application file for complete search history.

(56) References Cited

U.S. PATENT DOCUMENTS

| | | | |
|---|---|---|---|
| 3,085,258 | A | 4/1963 | Wolferts |
| 4,724,555 | A | 2/1988 | Poehner et al. |

(Continued)

FOREIGN PATENT DOCUMENTS

| | | | |
|---|---|---|---|
| AU | 2010202928 | A1 | 1/2011 |
| CN | 101077325 | A | 11/2007 |

(Continued)

OTHER PUBLICATIONS

English language abstract and machine-assisted translation for CN 101077325 extracted from espacenet.com database on Aug. 29, 2018, 7 pages.

(Continued)

*Primary Examiner* — Bryan A Evans

(74) *Attorney, Agent, or Firm* — Howard & Howard Attorneys PLLC

(57) ABSTRACT

A patient mobility system for early patient ambulation. The system includes a patient support apparatus comprising a patient support surface supported by a base adapted to rest upon a floor surface. An ambulation device is removably coupled to the patient support apparatus and comprises a barrier. In a coupled configuration, the ambulation device is supported off of the floor surface and the barrier prevents egress by being adjacent to a side of said patient support surface and having a height sufficient to at least partially extend above the patient support surface. In a decoupled configuration, the ambulation device engages the floor surface and provides support to the patient during ambulation away from the patient support apparatus. The barrier may comprise articulating members configured to articulate between a barrier configuration in the coupled configuration, and a deployed configuration with wheels engaging the floor surface in the decoupled configuration.

20 Claims, 10 Drawing Sheets

(52) U.S. Cl.
CPC ..... *A61G 7/1042* (2013.01); *A61H 3/04* (2013.01); *A61G 2203/80* (2013.01)

(56) References Cited

U.S. PATENT DOCUMENTS

| | | | |
|---|---|---|---|
| 4,805,249 | A | 2/1989 | Usman et al. |
| 4,819,283 | A | 4/1989 | DiMatteo et al. |
| 4,987,620 | A | 1/1991 | Sharon |
| 5,103,511 | A | 4/1992 | Sequin |
| 5,134,737 | A | 8/1992 | Wyman |
| 5,230,113 | A | 7/1993 | Foster et al. |
| 5,257,426 | A | 11/1993 | Leoutsakos |
| 5,299,334 | A | 4/1994 | Gonzalez |
| 5,398,357 | A | 3/1995 | Foster |
| 5,513,406 | A | 5/1996 | Foster et al. |
| 5,555,582 | A | 9/1996 | Jerideau |
| 5,613,252 | A | 3/1997 | Yu et al. |
| 5,680,661 | A | 10/1997 | Foster et al. |
| 5,715,548 | A | 2/1998 | Weismiller et al. |
| 6,374,436 | B1 | 4/2002 | Foster et al. |
| 6,397,416 | B2 | 6/2002 | Brooke et al. |
| 6,640,360 | B2 | 11/2003 | Hornbach et al. |
| 6,694,548 | B2 | 2/2004 | Foster et al. |
| 6,725,474 | B2 | 4/2004 | Foster et al. |
| 6,851,142 | B2 | 2/2005 | Stryker et al. |
| 7,636,966 | B2 | 12/2009 | Gallant et al. |
| 7,716,762 | B2 | 5/2010 | Ferraresi et al. |
| 7,761,942 | B2 | 7/2010 | Benzo et al. |
| 7,886,379 | B2 | 2/2011 | Benzo et al. |
| 8,336,133 | B2 | 12/2012 | Palay et al. |
| 8,474,076 | B2 | 7/2013 | Hornbach |
| 8,578,531 | B2 | 11/2013 | Abernathey et al. |
| 8,677,524 | B2 | 3/2014 | Kume et al. |
| 8,793,824 | B2 | 8/2014 | Poulos et al. |
| 8,844,075 | B2 | 9/2014 | Heimbrock |
| 8,864,205 | B2 | 10/2014 | Lemire et al. |
| 8,959,681 | B2 | 2/2015 | Richards |
| 8,973,187 | B2 | 3/2015 | Hornbach |
| 9,138,173 | B2 | 9/2015 | Penninger et al. |
| 9,306,322 | B2 | 4/2016 | Bhimavarapu et al. |
| 9,940,810 | B2 | 4/2018 | Derenne et al. |
| 2004/0064886 | A1 | 4/2004 | Alverson et al. |
| 2004/0177445 | A1 | 9/2004 | Osborne et al. |
| 2006/0085914 | A1 | 4/2006 | Peterson et al. |
| 2006/0130239 | A1 | 6/2006 | Smith |
| 2010/0017964 | A1 | 1/2010 | Kruse |
| 2010/0064439 | A1 | 3/2010 | Soltani |
| 2010/0212087 | A1 | 8/2010 | Leib et al. |
| 2011/0162142 | A1 | 7/2011 | Hakamiun et al. |
| 2012/0117732 | A1 | 5/2012 | O'Keefe |
| 2012/0124745 | A1 | 5/2012 | Heimbrock et al. |
| 2012/0137439 | A1 | 6/2012 | Heimbrock |
| 2012/0169093 | A1 | 7/2012 | Kume et al. |
| 2012/0198626 | A1 | 8/2012 | Richards |
| 2012/0198628 | A1 | 8/2012 | Richards |
| 2012/0297544 | A1 | 11/2012 | Griswold et al. |
| 2013/0212807 | A1 | 8/2013 | Manson et al. |
| 2013/0227787 | A1 | 9/2013 | Herbst et al. |
| 2015/0115628 | A1 | 4/2015 | Wittelsbuerger et al. |
| 2015/0115638 | A1 | 4/2015 | Lambarth et al. |
| 2015/0164722 | A1 | 6/2015 | Roussy et al. |
| 2016/0013837 | A1 | 1/2016 | Howell et al. |
| 2016/0022039 | A1 | 1/2016 | Paul et al. |
| 2016/0089283 | A1 | 3/2016 | DeLuca et al. |
| 2016/0184167 | A1* | 6/2016 | Naucke ..... A61H 3/04 280/47.4 |
| 2016/0193095 | A1 | 7/2016 | Roussy et al. |
| 2016/0302985 | A1 | 10/2016 | Tessmer et al. |
| 2016/0367420 | A1* | 12/2016 | Zerhusen ..... G08C 17/02 |
| 2017/0056267 | A1 | 3/2017 | Stryker et al. |
| 2017/0079434 | A1 | 3/2017 | Paul et al. |
| 2017/0165139 | A1* | 6/2017 | Afshani ..... A61G 7/1038 |
| 2017/0172829 | A1 | 6/2017 | Tessmer et al. |
| 2018/0000670 | A1 | 1/2018 | Bartley et al. |
| 2018/0000672 | A1 | 1/2018 | Heneveld, Jr. et al. |
| 2018/0000673 | A1 | 1/2018 | Bartley |
| 2018/0000674 | A1 | 1/2018 | Bartley |
| 2018/0000675 | A1 | 1/2018 | Heneveld, Jr. et al. |
| 2018/0064589 | A1 | 3/2018 | Sweeney et al. |
| 2018/0064591 | A1 | 3/2018 | Sweeney et al. |
| 2018/0064592 | A1 | 3/2018 | Sweeney et al. |
| 2018/0190100 | A1 | 7/2018 | Derenne et al. |
| 2018/0271729 | A1* | 9/2018 | Zerhusen ..... G08C 17/02 |
| 2019/0076314 | A1* | 3/2019 | Gordin ..... A61G 7/1025 |

FOREIGN PATENT DOCUMENTS

| | | | |
|---|---|---|---|
| DE | 4039253 | A1 | 6/1992 |
| EP | 262771 | A1 | 4/1988 |
| EP | 932385 | B1 | 3/2004 |
| EP | 2481388 | A1 | 8/2012 |
| EP | 2484326 | A2 | 8/2012 |
| EP | 2481388 | B1 | 11/2015 |
| GB | 905708 | A | 9/1962 |
| JP | 2014188340 | A | 10/2014 |
| KR | 20130076922 | A | 7/2013 |
| WO | 2007055051 | A1 | 5/2007 |
| WO | 2015126742 | A1 | 8/2015 |
| WO | 2016171746 | A1 | 10/2016 |

OTHER PUBLICATIONS

English language abstract and machine-assisted translation for DE 40 39 253 extracted from espacenet.com database on Aug. 29, 2018, 7 pages.

English language abstract and machine-assisted English language translation for JP 2014-188340 extracted from espacenet.com database on Aug. 29, 2018, 10 pages.

English language abstract and machine-assisted English translation for KR 2013-0076922 extracted from espacenet.com database on Aug. 20, 2018, 8 pages.

English language abstract and machine-assisted English translation for WO 2007/055051 extracted from espacenet.com database on Aug. 29, 2018, 17 pages.

Hill-Rom Services, Inc., "Progressa(TM) Bed System, Advancing mobility. Accelerating Recovery." 2013; 16 pages.

Hill-Rom Services, Inc., "Progressa(TM) Bed System, Technical Specifications", 2013; 4 pages.

L.L. Bean Inc., "Camp Comfort Recliner", URL: https://www.llbean.com/llb/shop/111730?page=llbean-camp-comfort-recliner.

Positive Posture LLC, "Luma Designer Recliner", URL: https://www.positiveposture.com/products/recliners/luma/.

Youtube, "Umano Medical Ook Snow New Hospital Bed (US Version) Video", Apr. 6, 2015, https://www.youtube.com/watch?v=MEnRNsVFqz0, 1 page.

* cited by examiner

FIG. 11A
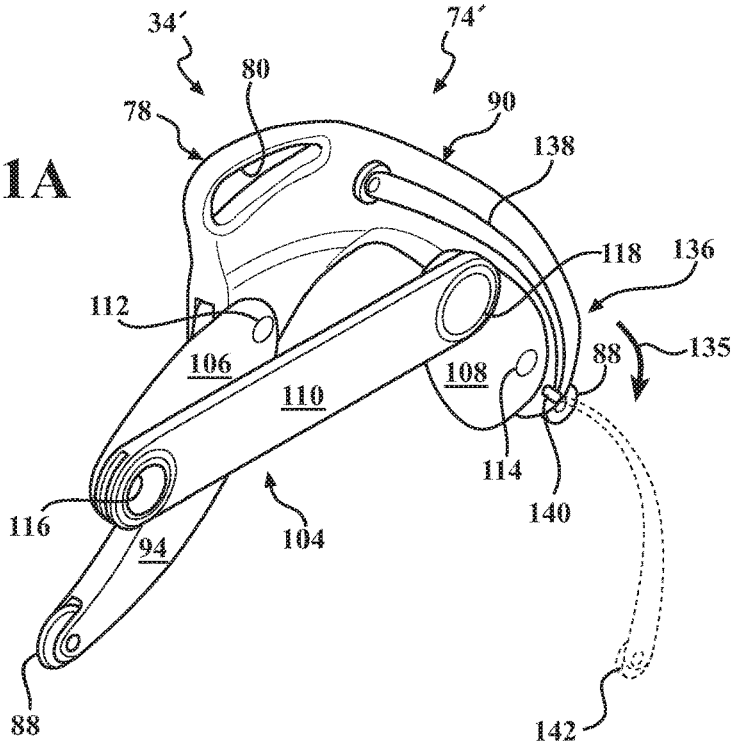
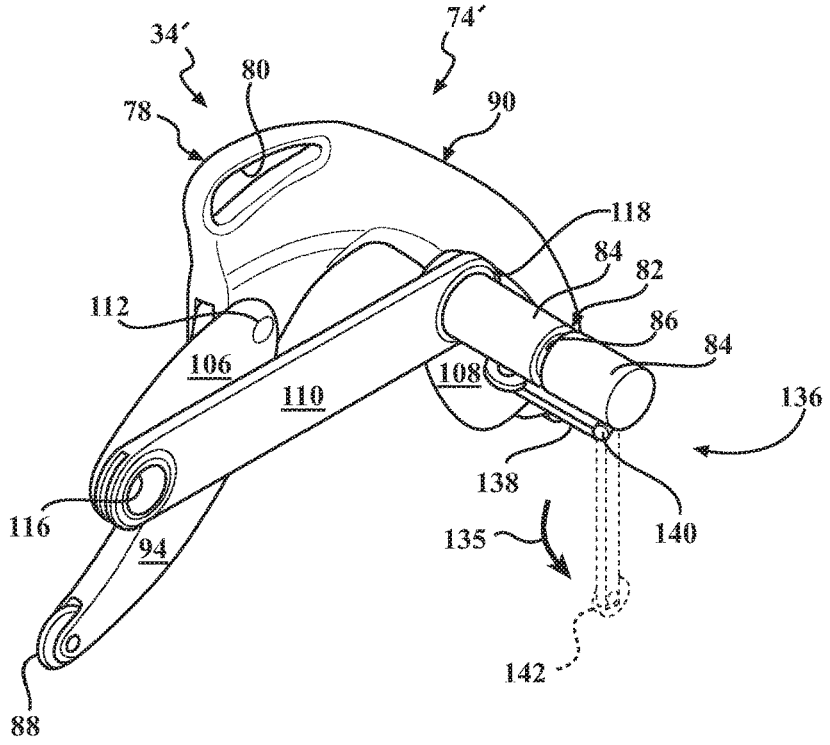
FIG. 11B

PATIENT MOBILITY SYSTEM WITH INTEGRATED AMBULATION DEVICE

CROSS REFERENCE TO RELATED APPLICATIONS

This application claims priority to and the benefit of U.S. Provisional Patent Application No. 62/532,134, entitled PATIENT MOBILITY SYSTEM WITH INTEGRATED AMBULATION DEVICE and filed on Jul. 13, 2017, the contents of which is hereby incorporated by reference in its entirety.

BACKGROUND

Patient support apparatuses, such as hospital beds, stretchers, cots, tables, wheelchairs, and chairs, facilitate care of patients in a health care setting. Most patients require only temporary use of a patient support apparatus during the initial stages of their illness or injury. Health care providers generally promote early patient mobility to advance patient recovery.

To that end, ambulation devices, such as walkers, crutches, and canes, provide ambulatory support to patients who are unable to ambulate without assistance. Often, the ambulation device is positioned next to the patient support apparatus, after which the patient is effectively transferred from the latter to the former. For example, a patient transfer might comprise rising from a sitting position on the patient support apparatus to a standing position at least partially supported by the ambulation device.

Accidents associated with patient transfers are a common source of injuries. A caregiver is often unsure of the patient's weight bearing capacity and/or unable to physically support the patient in the unfortunate event of a sudden fall. In fact, caregivers likewise often suffer physical injuries during patient transfers. Further, the fear of being held responsible for a patient falling under one's care often makes the caregivers hesitant to promote early patient mobility, thereby delaying the ultimate recovery of the patient.

Promoting early patient mobility is an area of much interest and development. Conventional patient support apparatuses positionable in different configurations such as a bed configuration, a chair configuration, and several configurations therebetween, require complex systems to achieve the motion. In the chair configuration, a patient is more likely to successfully rise to a standing position during a patient transfer. However, upon attempting the patient transfer, further assistance may not be readily available, such as support with ambulation away from the patient support apparatus. Conventional walkers may be unavailable or retrieved from another location in the facility, adding time and effort to the patient transfer.

Therefore, a need exists in the art for a patient mobility system designed to overcome one or more of the aforementioned disadvantages.

BRIEF DESCRIPTION OF THE DRAWINGS

Advantages of the present disclosure will be readily appreciated as the same becomes better understood by reference to the following detailed description when considered in connection with the accompanying drawings:

FIG. 11A is a perspective view of an ambulation device in accordance with another exemplary embodiment of the present disclosure.

FIG. 11B is a perspective view of an ambulation device in accordance with another exemplary embodiment of the present disclosure.

DETAILED DESCRIPTION

Figure 1:
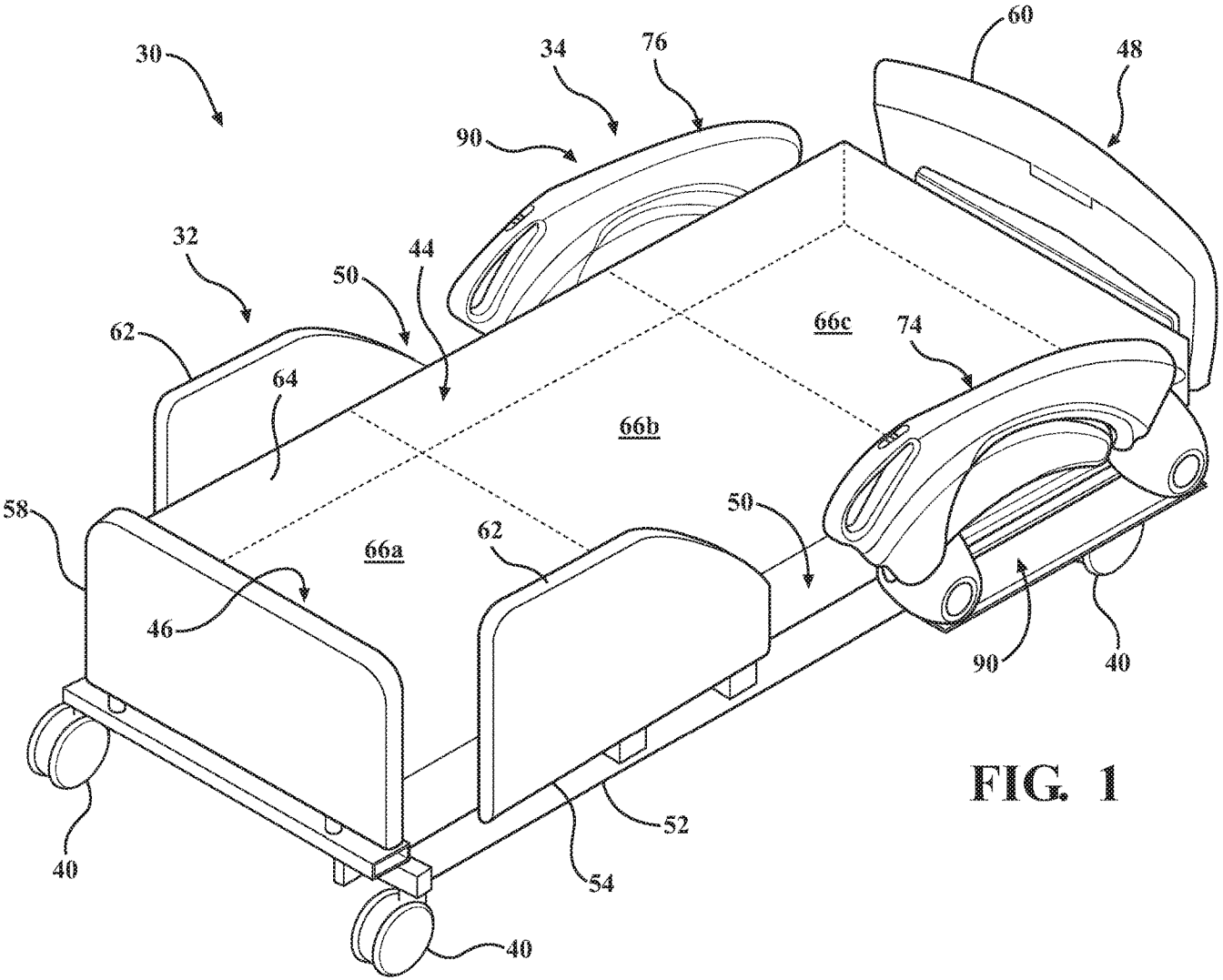
FIG. 1 is a perspective view of the patient mobility system in accordance with an exemplary embodiment of the present disclosure with an ambulation device shown coupled to a patient support apparatus.

FIG. 1 illustrates a patent mobility system 30 in accordance with an exemplary embodiment of the present disclosure. The patient mobility system 30 comprises a patient support apparatus 32 and an ambulation device 34. The patient support apparatus 32 may be used by a patient during their stay at a medical facility and may be used to move the patient from one location to another. The patient support apparatus 32 illustrated in the figures is a hospital bed, but alternatively may be a stretcher, cot, chair, or similar support apparatus. The ambulation device 34 is configured to provide support to the patient during ambulation away from the patient support apparatus 32 in a manner to be described. The ambulation device 34 may operate as a walker or another similar assistive device (e.g., a rollator), a patient transport apparatus, or the like.

Figure 2:
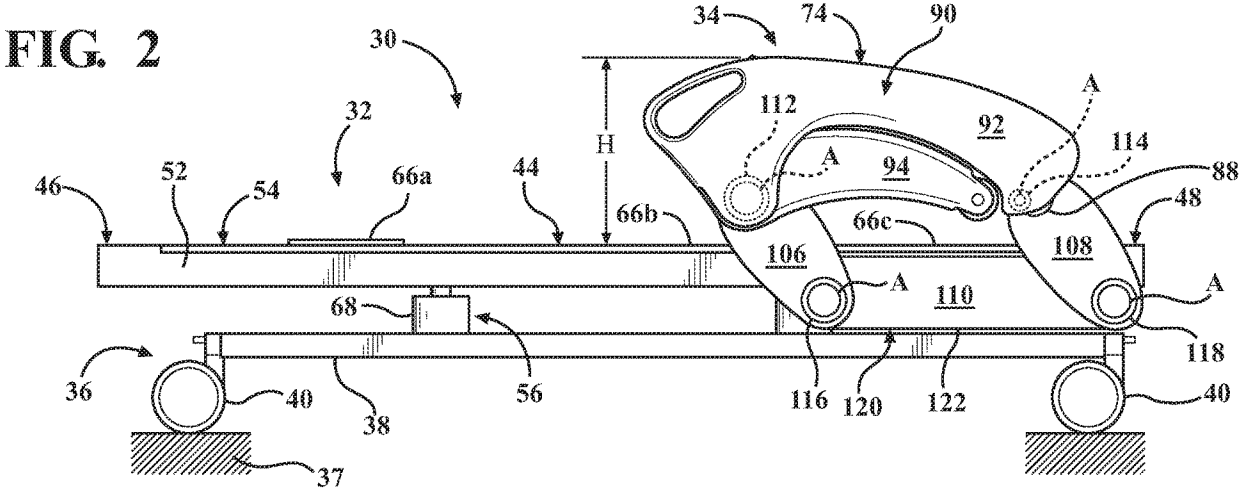
FIG. 2 is a side elevation view of the patient mobility system of FIG. 1. A headboard, footboard, and two of the side rails of FIG. 1 are not shown for illustrative purposes.

Referring to FIGS. 1 and 2, the patient support apparatus 32 comprises a base 36. The base 36 is adapted to rest upon a floor surface 37 and support and stabilize the patient support apparatus 32. The base 36 may comprise elongated frame members 38 of any suitable length to provide adequate longitudinal and transverse stability to the patient support apparatus 32. FIG. 2 shows the elongated frame members 38 in a rectangular arrangement generally oriented parallel to the floor surface 37. It is understood that the construction of the base 36 may take on any known or conventional design, and is not limited to that specifically set forth above.

The base 36 comprises wheels 40 configured to facilitate transport over the floor surface 37. The wheels 40 preferably are casters configured to rotate and swivel relative to the base 36 during transport. In certain embodiments, the wheels 40 are non-steerable, steerable, non-powered, powered, or combinations thereof. For example, FIG. 1 shows the patient support apparatus 32 with four non-powered wheels disposed proximate to a corner of the rectangular arrangement of the elongated frame members 38 of the base 36. One exemplary powered wheel system is described in commonly owned U.S. Patent Application Publication No. 2016/0089283, filed on Dec. 10, 2015, the entire contents of which are hereby incorporated by reference. Additional wheels are contemplated, and conversely it is understood that the patient support apparatus 32 may not include wheels.

The patient support apparatus 32 comprises a patient support surface 44 supported by the base 36. Multiple patient support surfaces 44 are shown, including one provided by a mattress 64 to be described. The patient support surface 44 comprises a head end 46, a foot end 48, and opposing sides 50 separating the head end 46 and the foot end 48. The patient support surface 44 is spaced above the base 36, such as by an intermediate frame 52 supporting a patient support deck 54. FIG. 1 shows the intermediate frame 52 comprising members supporting and defining an area comprising the patient support deck 54. The intermediate frame 52 may further comprise structural members adapted to move upon actuation of a lift device 56 to be described. Exemplary structural members may be adapted to move in a scissor-like motion as the lift device 56 is actuated. It is understood that the construction of the intermediate frame 52 may take on any known or conventional design, and is not limited to that specifically set forth above.

The patient support apparatus 32 may comprise a headboard 58 coupled to the intermediate frame 52 at the head end 46 of the patient support surface 44, and/or a footboard 60 coupled to the intermediate frame 52 or the patient support deck 54 at the foot end 48 of the patient support surface 44. The headboard 58 and the footboard 60 at least partially extend above the patient support surface 44 of the patient support apparatus 32 to obstruct or prevent egress of the patient from the patient support apparatus 32. In some embodiments, the headboard 58 and/or the footboard 60 may comprise a removable structure of the patient support apparatus 32.

Likewise, the patient support apparatus 32 may comprise side rails 62 coupled to the intermediate frame 52 or patient support deck 54 and positioned adjacent the opposing sides 50 of the patient support surface 44. The side rails 62 may be further positioned adjacent the opposing sides 50 and proximate the head end 46 and/or the foot end 48 of the patient support surface 44. FIG. 1 shows the side rails 62 positioned adjacent the opposing sides 50 and proximate the head end 46. The side rails 62 at least partially extend above the patient support surface 44 of the patient support apparatus 32 to obstruct or prevent egress of the patient from the patient support apparatus 32. In certain embodiments, the side rails 62 are movable between a raised position in which the side rails 62 are at least partially extending above the patient support surface 44, a lowered position with no such obstruction such as to permit egress of the patient, and one or more intermediate positions.

A mattress 64 may be disposed on the patient support deck 54 and define one of the patient support surfaces 44, as shown in FIG. 1. In certain embodiments, a separate, modular mattress pad (not shown) may be provided and disposed upon the mattress 64 to define another patient support surface 44. In some embodiments, no mattress is provided and the patient support deck 54 may define the sole patient support surface 44. It is understood that any suitable component of the patient support apparatus 32 may define at least a portion of the patient support surface 44 to support the patient, either directly or indirectly, and support of the patient may be effected in a number of different ways.

Figure 3:
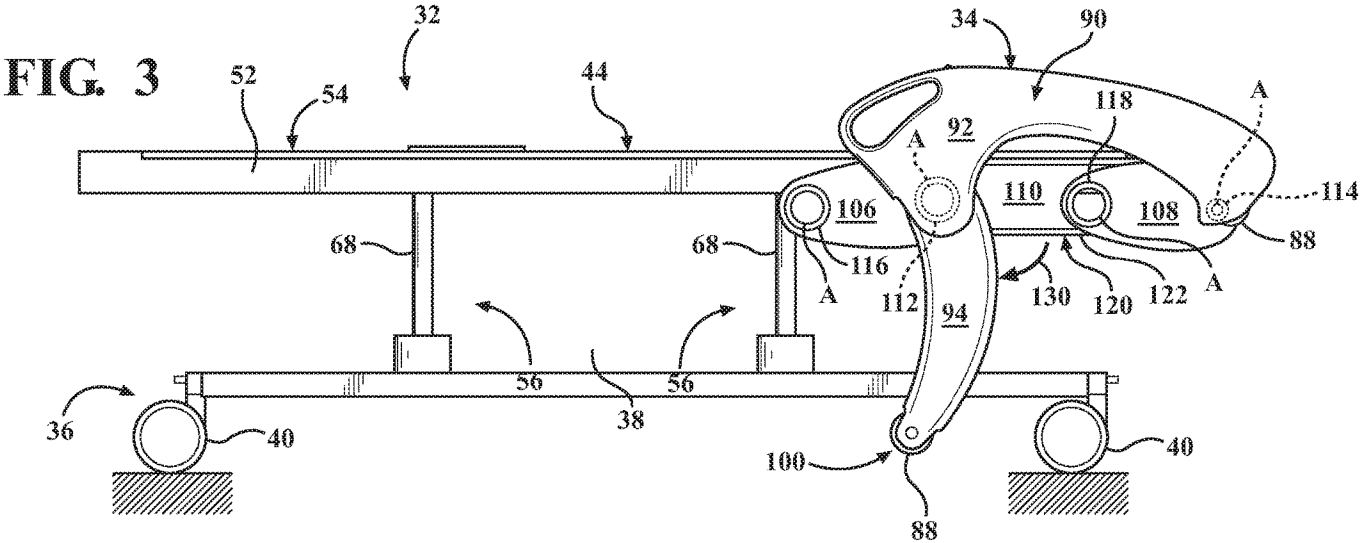
FIG. 3 is a side elevation view of the patient mobility system of FIG. 1 with the ambulation device in a first stage of decoupling. A patient support surface of the patient support apparatus is shown in a raised position relative to the base.

The patient support apparatus 32 comprises the lift device 56 adapted to move the patient support surface(s) 44 relative to the base 36. The lift device 56 moves the patient support surface 44 relative to the base 36 between a first position and a second position, and any number of positions therebetween. FIGS. 2 and 3 show the patient support surface 44 in the first position and the second position, respectively, with the patient support surface 44 generally lowered in the first position relative to the second position. In other words, the patient support apparatus 32 of FIG. 2 is lowered in the first position, and the patient support apparatus 32 of FIG. 3 is raised or elevated in the second position.

The lift device 56 may comprise one or more actuators 68 coupled to the base 36 and the patient support deck 54 with the actuators 68 adapted to move the patient support deck 54 relative to the base 36. FIGS. 2 and 3 show the actuators 68 comprising two linear actuators (e.g., hydraulic, pneumatic, and/or electric) each coupled to the base 36 and the patient support deck 54 at suitable locations to effectuate the movement of the patient support deck 54, and hence the patient support surface 44, relative to the base 36. It is also contemplated the actuators 68 may be coupled to any suitable structure of the intermediate frame 52. An exemplary movement may comprise operating the actuators 68 in tandem to raise or lower the patient support surface 44 between the first and second positions while maintaining the orientation of the patient support surface 44 (e.g., horizontal, angled or tilted, etc.). For example, the patient support surface 44 may be raised or lowered to the first and second positions with the patient support surface 44 oriented at a non-zero angle. The actuators 68 may be individually controlled by a controller 152 (FIG. 12) to adjust the angle or tilt the patient support surface 44, such as to achieve the Trendelenburg or reverse Trendelenburg positions. Other lift devices are contemplated, such as the lift assembly shown in U.S. Patent Application Publication No. 2016/0302985, the entire contents of which are hereby incorporated by reference.

The patient support apparatus 32, particularly the patient support deck 54, may comprise articulating sections 66*a*, 66*b*, 66*c* configured to articulate the patient support surface 44 between various configurations to be described. Referring to FIG. 2, the articulating sections 66*a*, 66*b*, 66*c* may further comprise a back section or fowler 66*a*, a seat section 66*b*, and a foot section 66*c*. The fowler 66*a* is proximate the head end 46, and the foot section 66*c* is proximate the foot end 48. The seat section 66*b* is intermediate the fowler 66*a* and the foot section 66*c*. The mattress 64 may be sufficiently flexible to conform to the various configurations of the articulating sections 66*a*, 66*b*, 66*c*. In certain embodiments, the mattress 64 further comprises discrete or semi-discrete mattress sections each associated with one of the articulating sections 66*a*, 66*b*, 66*c* such that the mattress sections articulate with articulation of the articulating sections 66*a*, 66*b*, 66*c*. While three of the articulating sections 66*a*, 66*b*, 66*c* are illustrated in FIGS. 1 and 2, for example, the present disclosure contemplates any number and/or type of articulating sections may be incorporated. In other exemplary embodiments, the patient support deck 54 may be rigid and unable to articulate.

Referring to FIGS. 1 and 2, actuators (not shown) may be provided and adapted to articulate the articulating sections 66*a*, 66*b*, 66*c* of the patient support deck 54. The actuators are coupled to any suitable structure of the base 36, intermediate frame 52, and/or patient support deck 54 to effectuate the movement of the articulating sections 66*a*, 66*b*, 66*c*. The articulating sections 66*a*, 66*b*, 66*c* may be positioned horizontally such that the patient support deck 54 is substantially planar. The arrangement may be considered a bed configuration of the patient support apparatus 32 as shown in FIGS. 1-4 and 8-10. In certain embodiments, the fowler 66*a* may be pivoted with the actuators to a non-zero angle relative to horizontal to provide incline for the upper body of the patient. Such an arrangement may be considered an inclined configuration of the patient support apparatus 32. In certain embodiments, the seat section 66*b* and/or the foot section 66*c* may be pivoted with the actuators to non-zero angles relative to the horizontal such that the patient support surface 44 beneath the patient's legs is an inverted V-shaped surface. Such an arrangement may be considered a gatch configuration of the patient support apparatus 32. The gatch configuration may position the patient's legs with knees flexed for comfort and improved circulation. Positioning the seat and foot sections 66*b*, 66*c* in the gatch configuration may be in addition to positioning the fowler 66*a* in the inclined configuration. The actuators may be adapted to articulate the articulating sections 66*a*, 66*b*, 66*c* of the patient support deck 54 to numerous other configurations of the patient support apparatus 32 not explicitly described herein. It is understood that the articulation of the articulating sections 66*a*, 66*b*, 66*c* of the patient support deck 54 may be independent of or in conjunction with moving the patient support surface 44 between the first and second positions (heights) and/or with the patient support surface 44 being level or oriented at a non-zero angle.

Figure 4:
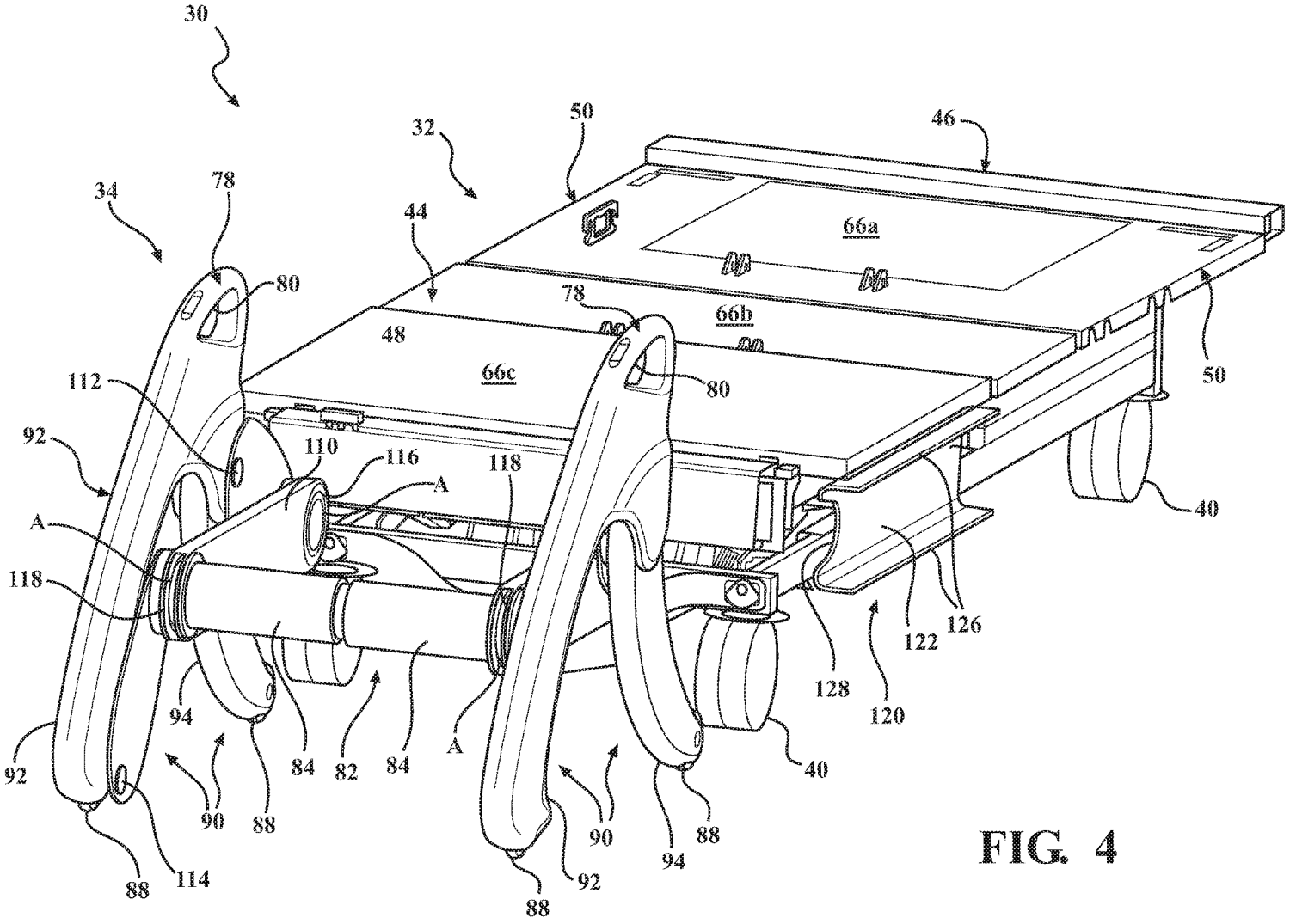
FIG. 4 is a perspective view of the patient mobility system of FIG. 1 with the ambulation device shown decoupled from the patient support apparatus.

The patient mobility system 30 comprises the ambulation device 34 removably coupled to the patient support apparatus 32. When coupled, the ambulation device 34 and the patient support apparatus 32 define a coupled configuration, and when decoupled, the ambulation device 34 and the patient support apparatus 32 define a decoupled configuration. FIGS. 1-3, 8 and 9 show the ambulation device 34 and the patient support apparatus 32 in the coupled configuration, and FIGS. 4 and 10 shows the ambulation device 34 and the patient support apparatus 32 in the decoupled configuration. The ambulation device 34 is advantageously a functional component of the patient mobility system 30 in both the coupled and decoupled configurations in manners to be described.

The ambulation device 34 comprises a barrier 74. The barrier 74 is configured to obstruct or prevent egress of the patient by being adjacent to one of the opposing sides 50 of the patient support surface 44 in the coupled configuration. FIGS. 1 and 2 show the barrier 74 and a second barrier 76 positioned adjacent the opposing sides 50 of the patient support surface 44. In the exemplary embodiment illustrated, the barriers 74, 76 are positioned proximate the foot end 48. Alternatively, the barriers 74, 76 may be positioned proximate the head end 46. It is further understood that a second ambulation device (not shown) may be provided with the second ambulation device comprising the barriers 74, 76 positioned proximate the head end 46 or the foot end 48 opposite the barriers 74, 76 of the ambulation device 34. For example, the barriers of the second ambulation device are in lieu of conventional side rails 62 illustrated in the figures. In such an embodiment, no conventional side rails 62 may be necessary, as the barriers 74, 76 of the ambulation devices 34 are configured to obstruct or prevent egress of the patient by being adjacent to the opposing sides 50 of the patient support surface 44 in the coupled configuration.

The barrier 74 obstructing egress of the patient from one of the opposing sides 50 helps prevent inadvertent or unintentional falling episodes that may be injurious to the patient. In many respects, the barrier 74 operates as a side rail. Similar to the side rails 62 previously described, the barrier 74 may be movable between a raised position, a lowered position, and one or more intermediate positions in the coupled configuration. The raised position, as shown in FIGS. 1 and 2, at least partially extends above the patient support surfaces 44 for obstructing or preventing egress of the patient. The lowered position provides no such obstruction and may permit egress of the patient from one of the opposing sides 50. To move between the raised and lowered positions, a linkage 104 and actuators A to be described articulate the barrier 74 in a suitable manner. The barrier 74 may also move between any number of positions between the raised and lowered positions.

The barrier 74 is a functional component of the patient mobility system 30 in the coupled configuration by obstructing or preventing egress of the patient from the patient support apparatus 32. The barrier 74 is adjacent to one of the opposing sides 50 of the patient support surface 44 and has a height sufficient to at least partially extend above the patient support surfaces 44 when the patient support apparatus 32 and the ambulation device 34 are in the coupled configuration. For example, FIG. 2 shows an upper edge of the barrier 74 extending above the patient support surface 44 (without the mattress of FIG. 1) by a height H. Moving the barrier 74 between the raised and lowered positions may selectively alter the height H by which the barrier 74 extends above the patient support surface 44. For example, height H of the barrier 74 may be selectively adjusted between 6 inches and 5 feet, and more particularly between 1 feet and 3 feet.

In certain embodiments, the patient support apparatus 32 is adapted to support the ambulation device 34 off of the floor surface 37 in the coupled configuration. FIGS. 1 and 2, for example, show an entirety of the ambulation device 34 supported by the patient support apparatus 32 such that no structure of the ambulation device 34 is in contact with the floor surface 37. In certain embodiments, substantially an entirety of the ambulation device 34 is positioned at or above the base 36 and/or the patient support deck 54. Supporting the ambulation device 34 with the patient support apparatus 32 minimizes the footprint of the ambulation device 34 and maximizes the mobility of the patient mobility system 30. With the advantageous integration of the ambulation device 34 in the manner described, moving or transporting the patient mobility system 30 along the floor surface 37 requires little additional consideration of the ambulation device 34 supported by the patient support apparatus 32. In other words, the patient mobility system 30 may be moved or transported akin to a conventional hospital bed, for example, with the patient mobility system 30 further providing the advantageous features of the ambulation device 34 to be described.

Furthermore, in the coupled configuration the ambulation device 34 is adapted to move in a corresponding manner with movement of the patient support surface 44 between the first and second positions. The ambulation device 34 supportably coupled to the patient support apparatus 32 moves as the lift device 56 moves the patient support deck 54, and hence the patient support surface 44, relative to the base 36. With the patient support surface 44 in the first position, the second position, and all positions therebetween, the height of the barrier 74 of the ambulation device 34 at least partially extends above the patient support surface 44 in the coupled configuration. It is also understood that supporting the ambulation device 34 off the floor surface 37 provides or otherwise maintains suitable clearance under the patient support deck 54 to accommodate structures of the patient support apparatus 32, storage of equipment, and the like.

Referring to FIG. 4, the ambulation device 34 is configured to engage the floor surface 37 and provide support to the patient during ambulation away from the patient support apparatus 32 when the ambulation device 34 and the patient support apparatus 32 are in the decoupled configuration. Subsequent to being decoupled from the patient support apparatus 32 in a manner to be described, the barrier 74 of the ambulation device 34, either directly or indirectly, engages the floor surface 37 to support the patient during ambulation.

Figure 5:
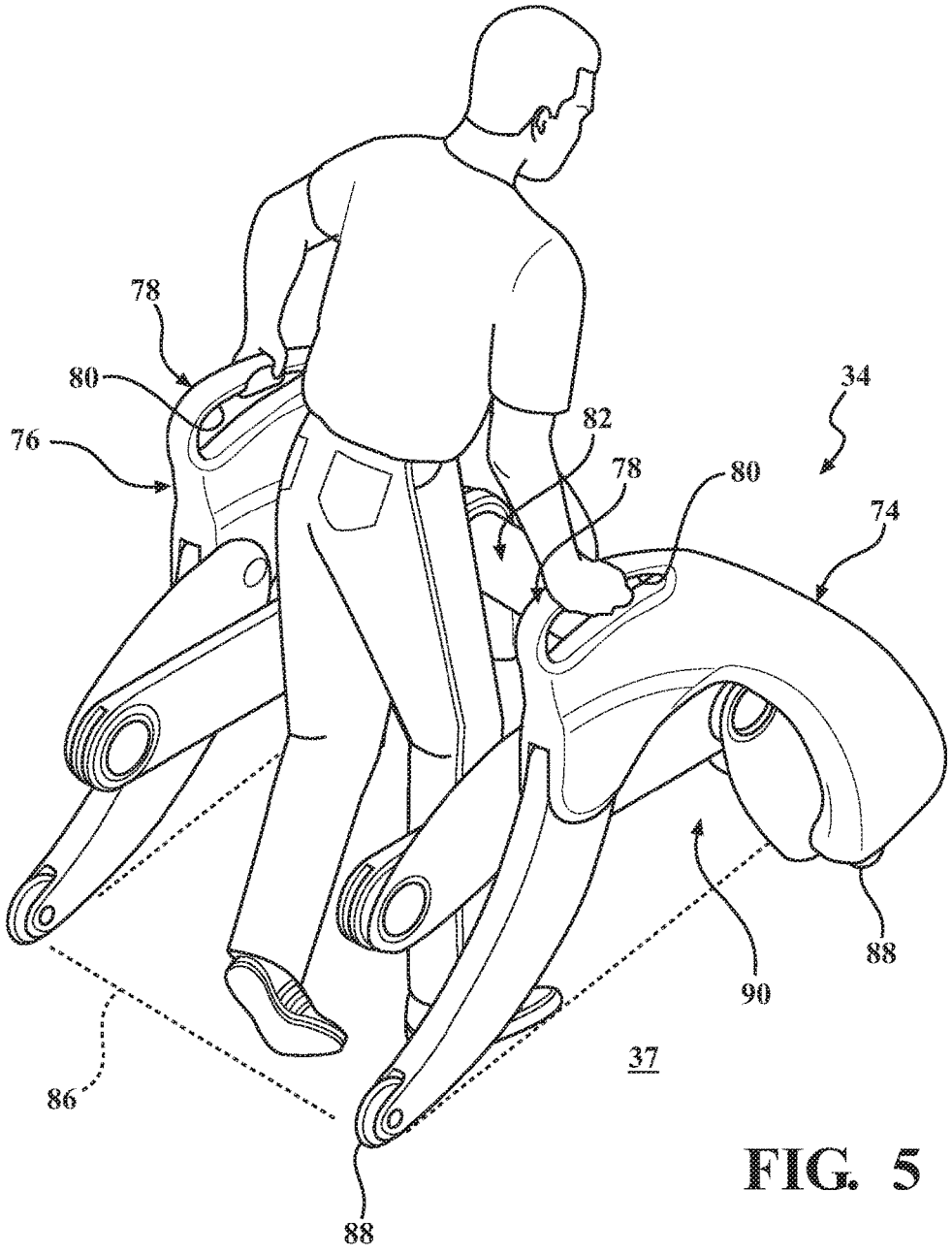
FIG. 5 is a perspective view of the ambulation device supporting a patient during ambulation away from the patient support apparatus.
Figure 6:
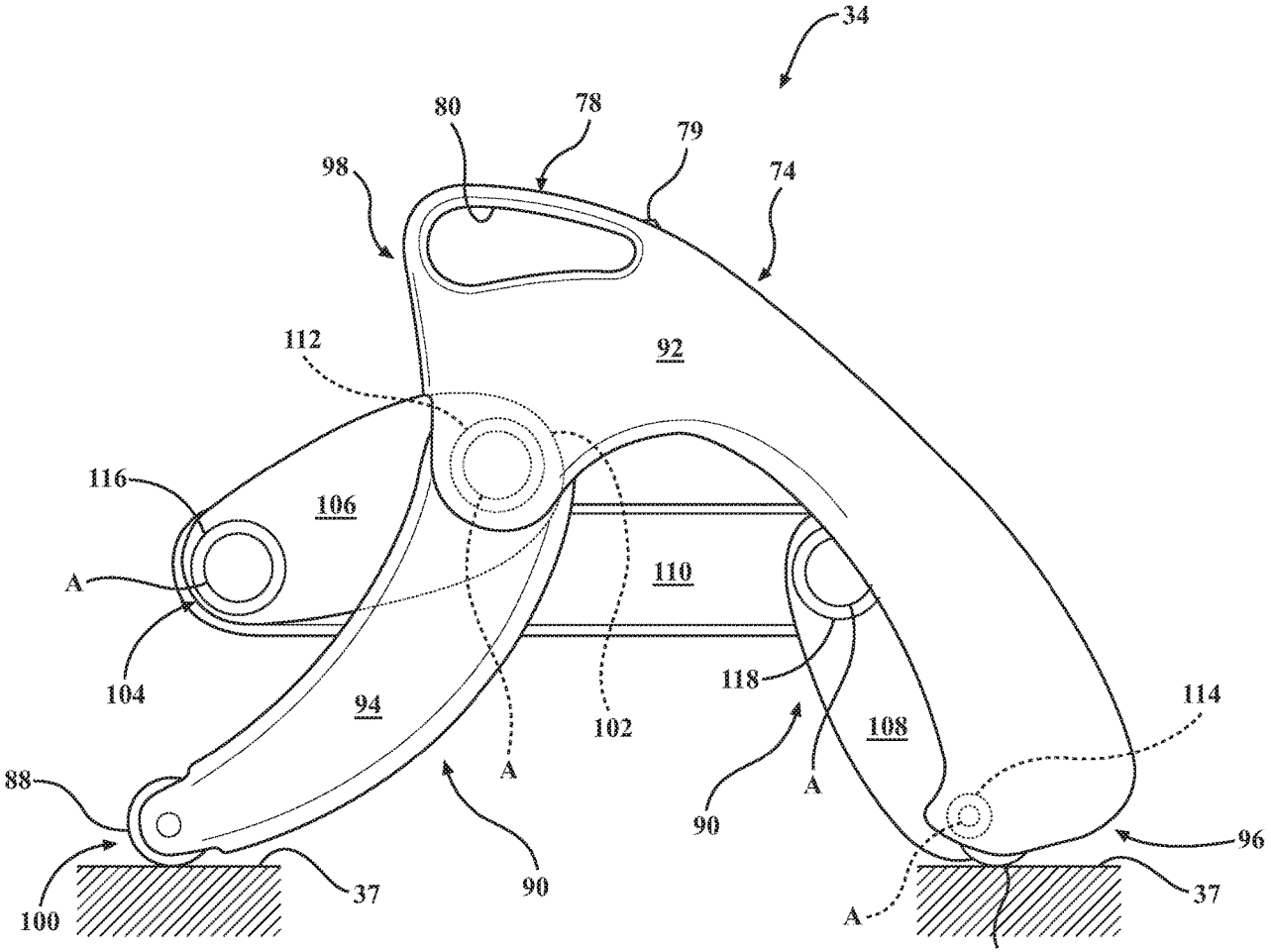
FIG. 6 is a side elevation view of the ambulation device of FIG. 5.
Figure 7:
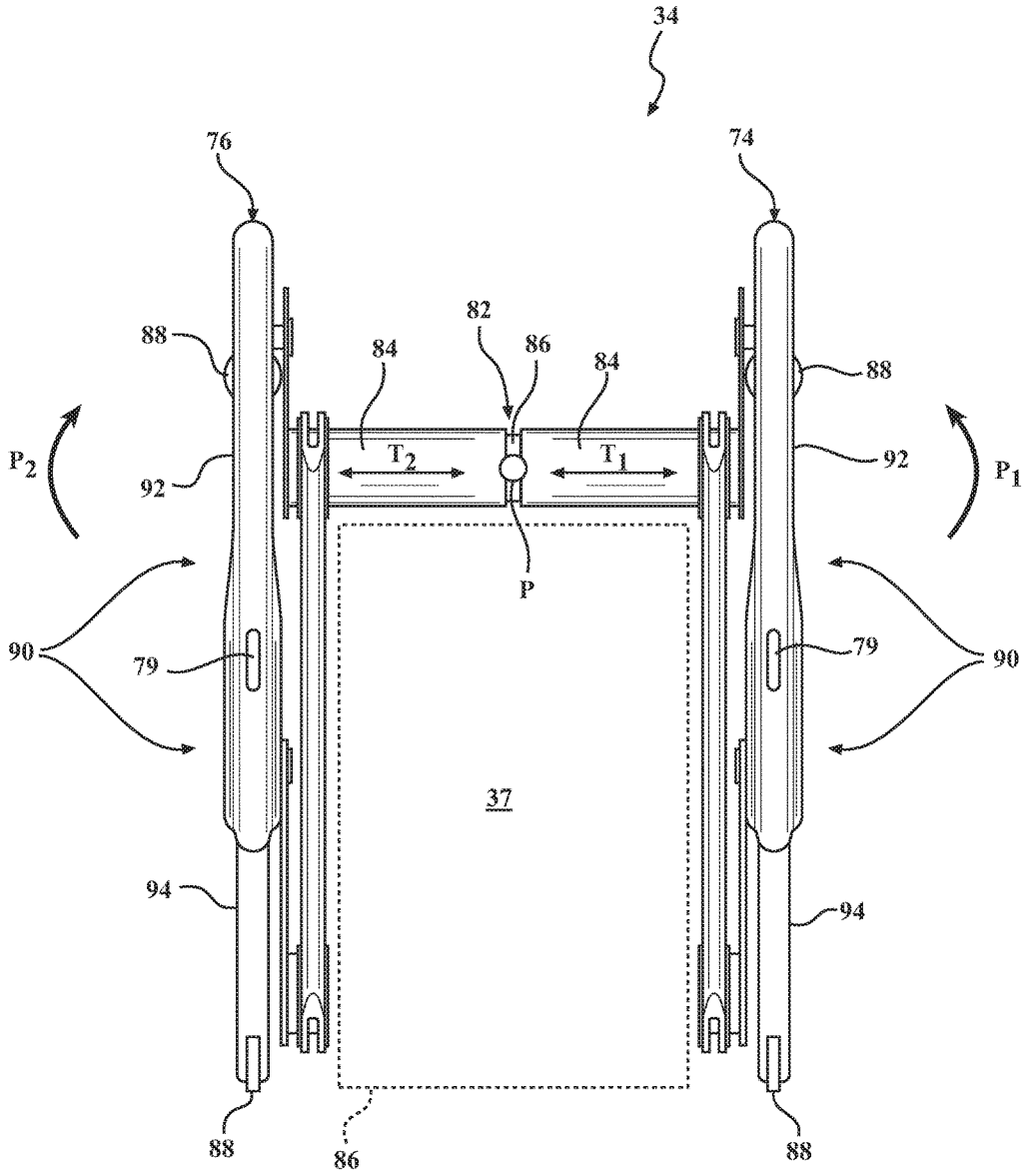
FIG. 7 is a top plan view of the ambulation device of FIG. 5.

FIGS. 5-7 show the ambulation device 34 in accordance with an exemplary embodiment of the present disclosure. The ambulation device 34 comprises the barrier 74 and, in certain embodiments, the second barrier 76 (the barriers 74, 76 may define a pair of barriers). One or both of the barriers 74, 76 may comprise a grip 78 for providing support to the patient during ambulation away from the patient support apparatus 32. For example, the grips 78 may comprise an edge or surface of the barriers 74, 76 suitably dimensioned so as to be grasped by the hands of the patient as shown in FIG. 5. In certain embodiments, one or both of the barriers 74, 76 comprise a handle 80 with the handles 80 coupled to the barriers 74, 76 to form the grips 78. For example, FIGS. 5 and 6 show the handles 80 defined by an aperture adapted to receive a portion of the patient's hand. The handles 80 may be provided in any suitable position about the barriers 74, 76 to be comfortably grasped by the patient during ambulation away from the patient support apparatus 32. The exemplary embodiment of the figures show two handles, but the present disclosure contemplates one, three, four or more handles. The grips 78 or handles 80, if applicable, may be of any suitable size, shape, and material to provide a comfortable, graspable structure for the patient.

The ambulation device 34 may further comprise a cross member 82 (see FIG. 5) coupling the barriers 74, 76. The cross member 82 may extend between and be positioned intermediate the barriers 74, 76. FIGS. 5 and 7 show an exemplary embodiment of the ambulation device 34 wherein the barriers 74, 76 are oriented substantially parallel to each other with the cross member 82 perpendicular to the barriers 74, 76. In certain embodiments, the cross member 82 may comprise a plurality of segments 84. The segments 84 may be separated by a pivot P so that the segments 84 may articulate about the pivot such that the cross member 82 is arcuate in shape or V-shaped. In such an arrangement, the barriers 74, 76 may not be oriented substantially parallel. For example, and with reference to FIG. 7, the segments 84 of the cross member 82 are separated by the pivot P. The segment 84 adjacent the barrier 74 may pivot about the pivot P in the direction of arrow $P_1$, and the segment 84 adjacent the second barrier 76 may pivot about the pivot P in the direction of arrow $P_2$. The resulting configuration of the cross member 82 may be V-shaped when viewed in plan. The pivoting may be effectuated by one or more actuators (not shown) coupled to the cross member 82 in a suitable manner. The extent of the relative pivoting between the segments 84 may be based on, for example, patient preference or sturdiness of the ambulation device 34.

The cross member 82 may comprise a length defined between the barriers 74, 76. The length of the cross member 82 may be adjustable to selectively alter the distance between the barriers 74, 76. In one exemplary embodiment, a coupling segment 86 may be slidably coupled to the segments 84 such that the segments 84 may telescope relative to the coupling segment 86. With continued reference with FIG. 7, the segment 84 adjacent the barrier 74 may translate inwardly or outwardly in the direction of arrows $T_1$, and the segment 84 adjacent the second barrier 76 may translate inwardly or outwardly in the direction of arrows $T_2$. The translation of the segments 84 inwardly or outwardly results in a corresponding change in the distance between the barriers 74, 76 and the grips 78 and the handles 80, if applicable. With a width of the patient support apparatus 32 to which the ambulation device 34 is removably coupled being greater than a width of a conventional ambulation device, it may be necessary to translate the barriers 74, 76 in the decoupled configuration such that the grips 78 and the handles 80, if applicable, are suitably spaced for the patient during ambulation away from the patient support apparatus. In certain embodiments, the translation may be effectuated by one or more actuators (not shown) coupled to the cross member 82 in a suitable manner. Additionally or alternatively, a biasing member (e.g., a spring) may be provided to impart relative translation between the segments 84 inwardly or outwardly, which results in a corresponding change in the distance between the barriers 74, 76 and the grips 78 and the handles 80, if applicable. The extent of the relative translation between the segments 84 may be based on, for example, patient preference or sturdiness of the ambulation device 34.

The barriers 74, 76 and the cross member 82 may cooperatively define a walking area 86 of the floor surface 37 for positioning the patient during ambulation away from the patient support apparatus 32. Referring to FIGS. 5 and 7, the walking area 86 may be defined as a projection on the floor surface 37 of the barriers 74, 76 and the cross member 82. The patient walking area 86 generally encompasses the widest dimension of the ambulation device 34 to form a generally rectangular shape. In other words, the patient walking area 86 is the rectangular projection of the greatest length and width dimension of the barriers 74, 76 collectively. In certain embodiments, the walking area 86 may provide support for the patient, if needed, on one, two, or three sides. For example, should the patient ambulating in the walking area 86 experience decreased stability, such as loss of balance to either side, the patient may rely on one of the barriers 74, 76 for support. In a more general sense, the patient walking area 86 is an area of the floor surface 37 that a patient typically occupies during ambulation while supported by the ambulation device 34.

A rear cross member (not shown) may be provided and extend between the barriers 74, 76 opposite the cross member 82. In such an embodiment, the walking area 86 may be defined as a projection on the floor surface 37 of the barriers 74, 76, the cross member 82, and the rear cross member (not shown) to provide support for the patient, if needed, on all four sides. It is also to be understood that the ambulation device 34 may provide support for the patient with the patient positioned outside of the walking area 86.

The ambulation device 34 may further comprise wheels 88 coupled the barrier 74 or to each of the pair of barriers 74, 76 to facilitate transport over the floor surface 37. The wheels 88 may be non-swivelable (see FIGS. 5-7) for generally limiting movement of the ambulation device 34 in the fore and aft. The wheels 88 being non-swivelable may provide lateral support to the patient and avoid inadvertent lateral movement. In certain embodiments, the wheels 88 may be swivelable, such as casters configured to rotate and swivel relative to the barriers 74, 76. The wheels 88 may be non-powered, powered, steered, non-steered, or combinations thereof. The wheels 88 may be coupled to one or more of the plurality of articulating members 90 to be described. FIGS. 5-7 show one of the wheels 88 coupled to each of four of the articulating members 90 of the ambulation device 34 in a generally rectangular arrangement. Additional wheels are contemplated, and conversely it is understood that the ambulation device 34 may not include wheels.

The barrier 74 of the ambulation device 34 comprises the articulating members 90. The articulating members 90 may function as primary structural components of the ambulation device 34. In a manner to be described in greater detail, the articulating members 90 are configured to articulate between a barrier configuration and a deployed configuration. FIGS. 1 and 2 show the articulating members 90 in the barrier configuration wherein the articulating members 90 comprise the barrier 74 preventing egress of the patient from the patient support apparatus 32. The articulating members 90 are typically in the barrier configuration when the patient support apparatus 32 and the ambulation device 34 are in the coupled configuration. The articulating members 90 may engage the floor surface 34 in the deployed configuration. The articulating members 90 are typically in the deployed configuration when the patient support apparatus 32 and the ambulation device 34 are in the decoupled configuration. As used herein, the barrier configuration may also be considered a non-deployed or a stored configuration. The barrier configuration may be defined by the articulating members 90 comprising the barrier 74 preventing egress of the patient from the patient support apparatus 32. In such a configuration, the articulating members 90 may be nested or otherwise positioned in close proximity to one another to be deemed "stored." Alternatively, the articulating members 90 may be considered non-deployed (or in a non-deployed configuration) when not in the deployed configuration as described throughout the present disclosure. It is further understood that there may be any number of transition configurations intermediate the barrier configuration and the deployed configuration. For example, the articulating members 90 may have articulated from the deployed configuration towards the barrier configuration such that the articulating members 90 are partially stored and in one of the transition configurations. The barrier configuration (also considered the stored configuration or non-deployed configuration) is such that egress of the patient from the patient support apparatus 32 is obstructed or prevented by the barrier 74 of the ambulation device 34.

Referring to FIGS. 6 and 7, the articulating members 90 may further comprise a leading arm 92 and a trailing arm 94. The leading arm 92 and the trailing arm 94 may be coplanar or parallel so as to provide the barrier 74 that is generally planar or flat in construction. Each of the leading arm 92 and the trailing arm 94 may be coupled to one of the wheels 88 such that, in the deployed configuration, the wheels 88 engage the floor surface in the decoupled configuration. It is to be understood that in embodiments comprising a pair of barriers 74, 76, each of the pair of barriers 74, 76 may comprise articulating members 90 movable between the barrier configuration and the deployed configuration.

The leading arm 92 may be elongate and arcuate when viewed in elevation, as shown in FIG. 6. The leading arm 92 may comprise a first end 96 with one of the wheels 88 coupled to the leading arm 92 at the first end 96, and a second end 98 opposite the first end 96 with the grip 78 disposed at the second end 98. The trailing arm 94 may be elongate and arcuate when viewed in elevation. The trailing arm 94 may comprise a first end 100 with one of the wheels 88 coupled to the trailing arm 94 at the first end 100, and a second end 102 opposite the first end 100. The trailing arm 94 may be coupled to the leading arm 92 at the second end 102. The coupling of the leading arm 92 and the trailing arm 94 may provide for a generally V-shaped arrangement when the articulating members 90 are in the deployed configuration.

In one exemplary embodiment, the trailing arm 94 is pivotally coupled to the leading arm 92. When the patient support apparatus 32 and the ambulation device 34 are in the decoupled configuration, the relative pivoting between the leading arm 92 and the trailing arm 94 may provide height adjustment of the grip 78 of the barrier 74. With continued reference to FIG. 6, moving the first ends 96, 100 towards one another causes the height of the grip 78 (relative to the floor surface 37) to increase, and conversely moving the first ends 96, 100 away from one another causes the height of the grip 78 to decrease. Stated differently, decreasing an angle between the leading arm 92 and the trailing arm 94 causes the height of the grip 78 to increase, and increasing an angle between the leading arm 92 and the trailing arm 94 causes the height of the grip 78 to decrease. The ambulation device 34 may be adjustable to any height between a minimum and a maximum, and/or include preset height positions. For example, the height may be adjusted in two inch, six inch, eight inch, or one foot amounts in response to an input from the patient. For another example, the preset height positions may be programmed by the patient based on their personal preferences. Selection of a previously programmed "stand/walk" setting may adjust the elevation of the ambulation device 34 to the preprogrammed elevation. The adjustment in elevation may adjust the grip 78 to a position most comfortable for the patient.

Further, the ambulation device 34 may include a brake mechanism (not shown) controllable by the patient. An input device 79 mounted in a suitable location on the barrier 74 may control the brake mechanism. FIGS. 6 and 7 show the input device 79 disposed on the leading arm 92 proximate the grip 78. In certain embodiments, the input device 79 is positioned to be actuated by a hand of the user while grasping the handle 80. The input device 79 is operably coupled to a brake of the brake mechanism, via a cable or otherwise, to selectively couple the brake and the wheel of the ambulation device 34 to slow or stop the ambulation device 34.

When the patient support apparatus 32 and the ambulation device 34 are in the coupled configuration, the relative pivoting between the leading arm 92 and the trailing arm 94 facilitates moving the articulating members 90 of the ambulation device 34 from the barrier configuration to the deployed configuration. The articulating members 90 further comprise a linkage 104 coupling the leading arm 92 and the trailing arm 94. The linkage 104 may comprise one or more links and connections between the links to impart the kinematic movement as the ambulation device 34 moves between the barrier configuration and the deployed configuration.

In the exemplary embodiment shown in the figures, the linkage 104 comprises a first link arm 106, a second link arm 108, and a third link arm 110. A first pivot 112 pivotally couples the first link arm 106 to the leading arm 92, and a second pivot 114 pivotally couples the second link arm 108 to the leading arm 92 (see FIG. 6). More specifically, the first link arm 106 may be pivotally coupled to the leading arm 92 proximate the second end 98, and the second link arm 108 may be pivotally coupled to the leading arm 92 proximate the first end 96. The third link arm 110 is pivotally coupled to the first link arm 106 at a third pivot 116, and to the second link arm 108 at a fourth pivot 118, as shown in FIG. 6. In certain embodiments, the leading arm 92 and the first, second, and third link arms 106, 108, 110 pivotally coupled as described at the first, second, third and fourth pivots 112, 114, 116, 118 comprises a four-bar linkage. In one example, the third link arm 110 comprises a floating link or connecting rod. In another example, such as when the third link arm 110 is disposed within a guide rail 122 to be described, the leading arm 92 comprises the floating link or the connecting rod of the linkage 104. Based on the relative lengths of the first, second, and third link arms 106, 108, 110, many types of kinematic motion can be achieved. Further, the linkage 104 may comprise a timing link (not shown) coupled to any one or more of the leading arm 92, the trailing arm 94, and the first, second, and third link arms 106, 108, 110. The timing link may be adapted to prevent kinematic inversion (e.g., a hitch point) of the linkage 104, when for example, the first, second, and third link arms 106, 108, 110 are collinear. In certain embodiments, actuators to be described may prevent unintended or undesirable kinematic motion of the linkage 104.

An actuator A, such as a rotary actuator, may be coupled to the leading arm 92 and the trailing arm 94 and adapted to pivot the trailing arm 94 relative to the leading arm 92. Further, one or more actuators A may provide relative pivoting between the structures at one or more of the first, second, third and fourth pivots 112, 114, 116, 118 as described. In one exemplary embodiment, an actuator A is disposed at each of the third pivot 116 and the fourth pivot 118 with no actuator required at the first pivot 112 and/or the second pivot 114. The actuator A disposed at the third pivot 116 facilitates relative pivoting between the first link arm 106 and the third link arm 110, and the actuator A disposed at the fourth pivot 118 facilitates relative pivoting between the second link arm 108 and the third link arm 110. Another one of actuators A facilitates pivoting between the leading arm 92 and the trailing arm 94. In one embodiment, the kinematic motion to move the articulating members 90 between the coupled configuration and the decoupled configuration may be achieved with three actuators A. It is understood that greater or fewer actuators A are contemplated, and the construction of the linkage 104 may not be limited to that specifically set forth above.

Referring to FIGS. 2-4, the patient mobility system 30 further comprises a rail system 120. The rail system 120 is adapted to slidably couple the patient support apparatus 32 and the ambulation device 34. The rail system 120 facilitates swift movement of the patient mobility system 30 between the coupled configuration in which the patient support apparatus 32 and the ambulation device 34 are coupled, and the decoupled configuration in which the patient support apparatus 32 and the ambulation device 34 are decoupled. The rail system 120 comprises the guide rail 122 coupled to the patient support apparatus 32. In certain embodiments, the guide rail 122 is coupled to the patient support deck 54, often positioned adjacent one of the opposing sides 50 of the patient support surface 44 at or proximate to the head end 46 or the foot end 48. The figures show the guide rail 122 positioned proximate the foot end 48 such that the ambulation device 34 decouples from the foot end 48 in a manner to be described. It is understood that, additionally or alternatively, the guide rail 122 may be coupled to the intermediate frame 52 and/or the base 36. In certain embodiments, including those shown in the figures, the rail system 120 comprises a second guide rail 124 coupled to the patient support apparatus 32 opposite the guide rail 122. Thus, the rail system 120 may comprise a pair of guide rails 122, 124. The rail system 120 is adapted to support the barriers 74, 76 of the ambulation device 34 in the coupled configuration. In other words, the guide rails 122 of the rail system 120 may be considered the functional interface between the patient support apparatus 32 and the ambulation device 34 in the coupled configuration.

The guide rail 122, and the second guide rail 124, if applicable, may be elongate and suitably shaped to receive the third link arm 110 of the articulating members 90 of the ambulation device 34. For example, and with reference to FIG. 4, the guide rail 122 may comprise upper and lower flanges 126 spaced apart at a distance generally corresponding to a width of the third link arm 110. The guide rail 122 is designed such that the third link arm 110 may move slidably between the flanges 126 along the length of the third link arm 110, but may be prevented from moving transverse to its length. In certain exemplary embodiments, including those shown in the figures, the guide rail(s) 122, 124 are oriented substantially parallel to the floor surface. It is contemplated that the guide rail(s) 122, 124 may be tilted or angled relative to the floor surface. For example, the guide rail(s) 122, 124 may be coupled to the patient support apparatus 32 in a manner which tilts the guide rail(s) 122, 124 downwardly towards the foot end 48 of the patient support apparatus 32. In another example, the guide rail(s) 122, 124 may be movably coupled to the patient support apparatus 32, such as with an actuator, to selectively tilt the guide rail(s) 122, 124 downwardly towards the foot end 48 of the patient support apparatus 32 prior to or during decoupling of the ambulation device 34 from the patient support apparatus 32. Providing a tilt or angle to the guide rail(s) 122, 124 may facilitate ease of moving of the ambulation device 34 and the patient support apparatus 32 between the coupled and decoupled configurations; e.g., improving coupling and decoupling of the third link arm 110 from the guide rail 122.

The guide rail 122 may comprise a cutout 128 (see FIG. 4) at one end proximate the foot end 58 of the patient support surface 44. The cutout 128 may be suitably shaped to receive the cross member 82 of the ambulation device 34 in the coupled configuration. In other words, the cross member 82 may be coupled to the linkage 104, and more particularly the third link arm 110, with the cross member 82 disposed within the cutout 128 when the third link arm 110 is disposed in the guide rail 122. In certain embodiments comprising the pair of guide rails 122, 124, the guide rails 122, 124 may each receive the third link arm 110 associated with one of a pair of articulating members 90 of the barriers 72, 74. The cross member 82 coupling the barriers 72, 74 extends between the guide rails 122, 124 in the coupled configuration.

Moving the ambulation device 34 from the barrier configuration to the deployed configuration will now be described with reference to FIGS. 2, 3 and 8-10. FIG. 2 shows the patient mobility system 30 with the patient support apparatus 32 and the ambulation device 34 in the coupled configuration. The third link arm 110 of the articulating members 90 is disposed within the guide rail 122. The guide rail 122 supports the articulating members 90 such that the ambulation device 34 is supported off of the floor surface 37 by the patient support apparatus 32. The articulating members 90 are in the barrier configuration and comprise the barrier 74 adjacent one of the opposing sides of the patient support surface 44 and having the height H at least partially extending above the patient support surface 44. The barrier 74 obstructs or prevents egress of the patient from the patient support apparatus 32.

The patient support apparatus 32 may move between the first and second positions with the lift device 56 as described. Regardless of the elevation of the patient support surface 44 relative to the base 36, the barrier 74 remains a functional component of the patient support apparatus 32 by having the height H extending above the patient support surface 44. Further, the barrier 74 may be moved between the raised and lowered positions in the coupled configuration. With continued reference to FIG. 2, the linkage 104 comprises a four-bar linkage with the leading arm 92 being the floating link. One or more actuators A associated with one or both of the third pivot 116 and the fourth pivot 118, for example, are actuated in a counterclockwise or clockwise direction. The first link arm 106 and the second link arm 108 pivot correspondingly in the counterclockwise or clockwise direction. As the first link arm 106 and the second link arm 108 pivot from a vertical orientation, the leading arm 92 coupled to both of the first link arm 106 and the second link arm 108 is effectively lowered towards the lowered position. The leading arm 92 may be lowered such that, for example, egress of the patient is permitted. It is understood that the leading arm 92 may be lowered to any number of intermediate positions. From the lowered position, for example, the actuator(s) A may be actuated in an opposite direction to raise the barrier 74 to the raised position such that the barrier 74 extends above the patient support surface 44 for obstructing or preventing egress of the patient.

FIG. 3 shows the patient mobility system 30 in what may be considered a first stage of decoupling. The trailing arm 94 is pivoted relative to the leading arm 92. One of the actuators A is adapted to pivot the trailing arm 94 away from the leading arm 92 in the direction of arrow 130. It is understood that the same actuator A may be configured to also pivot the first link arm 106 relative to the leading arm 92, or a separate actuator A may be used. In certain embodiments, the trailing arm 94 is pivoted relative to the leading arm 92 until the wheel 88 coupled at the first end 100 of the trailing arm 94 engages the floor surface 37. Depending on the length of the trailing arm 94 defined between the first end 100 and the second end 102, the patient support surface 44 may be moved between the first and second positions (i.e., raised or lowered) to accommodate the trailing arm 94 positioned above the floor surface 37. For example, FIG. 3 shows the patient support surface 94 generally elevated relative to FIG. 2 with the trailing arm 94 engaging the floor surface 37 with the wheels 40 of the patient support apparatus 32. In other embodiments, the trailing arm 94 is pivoted relative to the leading arm 92 with the wheel 88 coupled at the first end 100 of the trailing arm 94 remaining supported off the floor surface 37. It is noted that during the first stage of decoupling, the barrier 74 may remain positioned above the patient support surface 44 to obstruct or prevent egress of the patient from the patient support apparatus 32. In another exemplary embodiment, the barrier 74 may be moved below patient support surface 44 to permit egress of the patient from the patient support apparatus 32.

Figure 8:
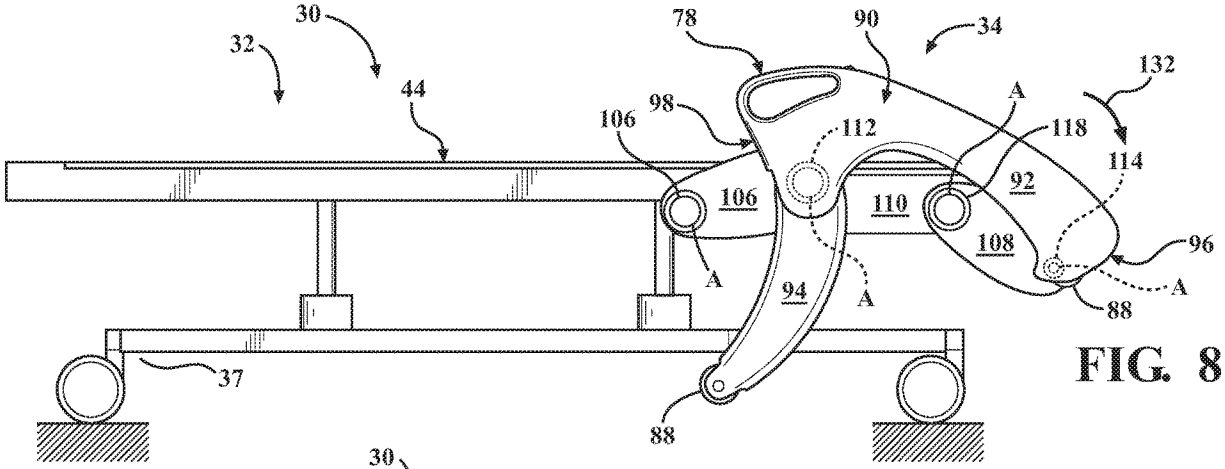
FIG. 8 is a side elevation view of the patient mobility system of FIG. 1 with the ambulation device in a second stage of decoupling.

Referring now to FIG. 8, the patient mobility system 30 is shown in what may be considered a second stage of decoupling. One or more of the actuators A associated with one or both of the third pivot 116 and the fourth pivot 118 are actuated, such as in a clockwise direction. In response to the actuation of the actuators A, the first link arm 106 and the second link arm 108 pivot about the third and fourth pivots 116, 118, respectively, in the direction of arrow 132. An actuator A may also be associated with the second pivot 114 and actuated concurrently. The actuators A associated with one or both of the third pivot 116 and the fourth pivot 118 may be actuated simultaneously to pivot the first link arm 106 and the second link arm 108 in unison. The second link arm 108 may be pivoted at a greater angular velocity than the first link arm 106 so as to pivot the leading arm 92 towards the floor surface 37. In other words, the first end 96 of the leading arm 92 moves towards the floor surface 37 more rapidly than the second end 98 of the leading arm 92. The resulting configuration is shown in FIG. 8 with the first and second link arms 106, 108 no longer parallel in orientation and the second pivot 114 closer to the floor surface 37 than the first pivot 112.

Figure 9:
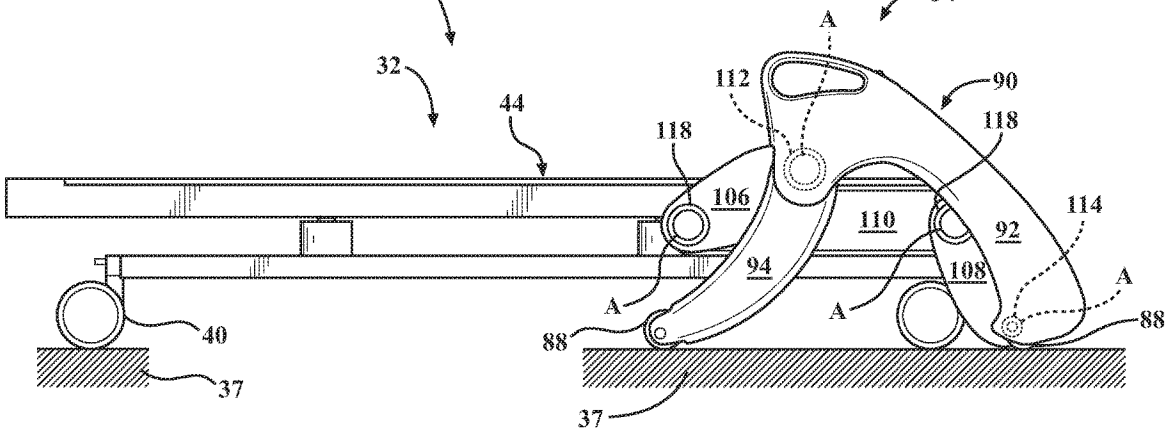
FIG. 9 is a side elevation view of the patient mobility system of FIG. 1 with the ambulation device in a third stage of decoupling.
Figure 10:
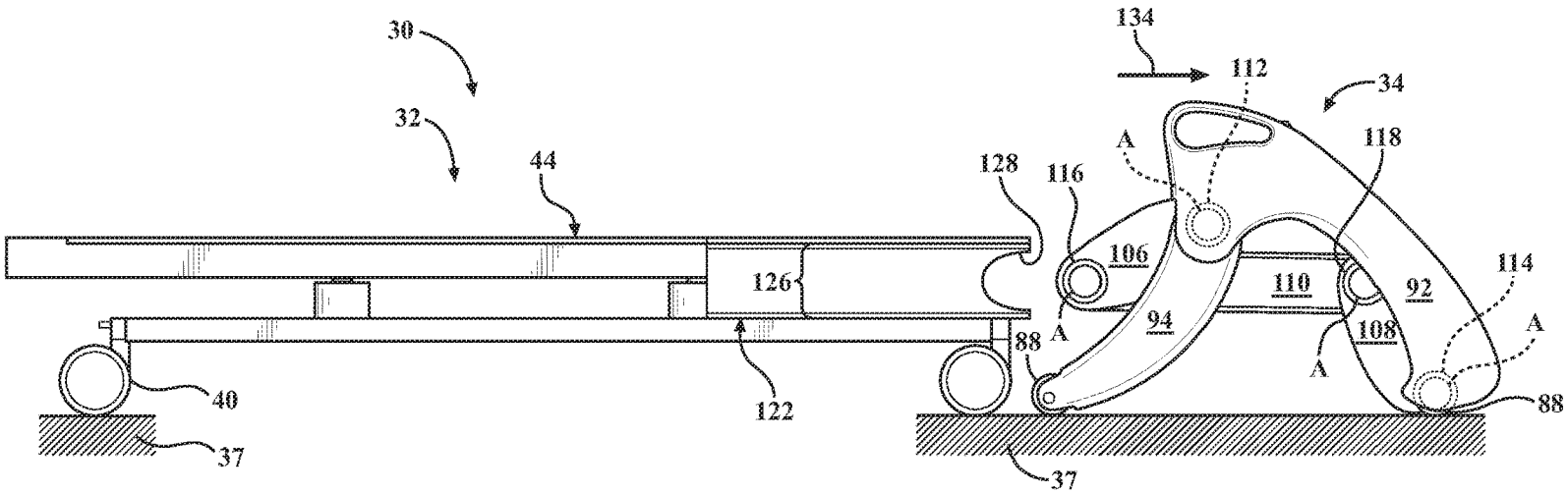
FIG. 10 is a side elevation view of the patient mobility system of FIG. 1 with the ambulation device in a fourth stage of decoupling.

The motion described above may continue until the wheel 88 coupled at the first end 96 of the leading arm 92 engages the floor surface 37, as shown in FIG. 9. FIG. 9 shows the patient mobility system 30 in what may be considered a third stage of decoupling. The wheels 88 associated with each of the leading arm 92 and the trailing arm 94 engage the floor surface 37. In certain embodiments, the wheels 88 associated with each of the leading arm 92 and the trailing arm 94 remain supported off the floor surface 37 and may be generally level relative to the floor surface 37. The lift device 56 may be actuated to lower the patient support surface 44 relative to the base 36 in order to lower the wheels 88 into engagement with the floor surface 37. It is noted that the wheels 40 of the patient support apparatus 32 are also engaging the floor surface 37 in this exemplary embodiment. With the wheels 88 of the ambulation device 34 engaging the floor surface 37, the articulating members 90 may be considered to have moved from the barrier configuration to the deployed configuration. During the third stage of decoupling, the articulating members 90 of the barrier 74 may remain obstructing or preventing egress of the patient from the patient support apparatus 32. Further, with or without the wheels 88 engaging the floor surface 37, the patient mobility system 30 may be easily transported across the floor surface 37 akin to a conventional hospital bed. It is also contemplated that in certain embodiments the wheels 40 of the patient support apparatus 32 may be positioned off of the floor surface with the ambulation device 34 engaging the floor surface.

Referring now to FIG. 10 showing what may be considered a fourth stage of decoupling of the patient mobility system 30 comprises decoupling the ambulation device 34 from the patient support apparatus 32. With the wheels 88 of the ambulation device 34 engaging the floor surface 37, the ambulation device 34 is moved along the floor surface 37 until the ambulation device 34 decouples from the rail system 120. FIG. 10 shows the ambulation device 34 moving in the direction of arrow 134 until third link arm 110 of the linkage 104 slidably disengages from within the guide rail 122 of the rail system 120. Notably, when the third link arm 110 disengages from within the guide rail 122, the third link arm 110 does not merely fall to the floor surface 37, but rather is held by brakes of the actuator(s) A being operable when decoupled. Alternatively, locking devices could be provided to hold the articulating members 90 when decoupled form the patient support apparatus 32. Moving the ambulation device 34 along the floor surface 37 may be facilitated by actuators (not shown) associated with one or more of the wheels 88, or by a user (e.g., a caregiver) applying a manual force to the ambulation device 34. Once the patient support apparatus 32 and the ambulation device 34 are decoupled defining the decoupled configuration, the ambulation device 34 is configured to provide support to the patient during ambulation away from the patient support apparatus 32. Therefore, the ambulation device 34 is a functional component of the patient mobility system 30 in the decoupled configuration.

The stages of decoupling above have been described with reference to the barrier 74 comprising the articulating members 90. It is to be understood that the stages of decoupling are applicable to the pair of barriers 74, 76 each comprising articulating members 90. In certain embodiments, the articulating members 90 associated with each of the barriers 74, 76 are configured to articulate in unison between the barrier configuration and the deployed configuration. In other embodiments, the articulating members 90 associated with each of the barriers 74, 76 are configured to articulate independently to one another.

Once in the decoupled configuration, the barriers 74, 76 may be spaced apart from one another by a distance at least equal the width of the patient support surface 44 of the patient support apparatus 32. As a result, the grips 78, or handles 80, if any, may be spaced apart from one another a distance at least equal the width of the patient support surface 44. In most cases the distance is too wide to be comfortably grasped by the hands of the patient. The length of the cross member 82 may be adjustable to selectively alter the distance between the barriers 74, 76 in the exemplary manner previously described. For example, the segments 84 of the cross member 82 telescope relative to one another or relative to the coupling segment 86 (see also FIG. 7). The segments 84 may translate inwardly, and the barriers 74, 76 coupled to each of the segments 84 translate inwardly in a corresponding manner. The amount of the translation between the segments 84 may be based on, for example, patient preference until the grips 78 and the handles 80, if applicable, are spaced apart at a distance comfortable to the patient. An exemplary arrangement is shown in FIG. 4 with the barriers 74, 76 spaced closer together than the width of the patients support apparatus 32.

The trailing arm 94 may be pivoted relative to the leading arm 92 to provide height adjustment of the grip 78 of the barrier 74 in the manner previously described. The first ends 96, 100 of the leading and trailing arms 92, 94 are moved towards or away from one another to cause the height of the grip 78 (relative to the floor surface 37) to increase or decrease, respectively. The grip 78 and handles 80 if applicable, may be positioned at any height between a minimum and a maximum, and/or include preset height positions.

With the ambulation device 34 decoupled from the patient support apparatus 32, the ambulation device 34 may be freely moved along the floor surface 37. The movement along the floor surface 37 may be autonomous, semi-autonomous, or dependent upon a manual force provided by a user. In certain embodiments, the ambulation device 34 is moved from proximate the foot end 48 of the patient support apparatus 32, as shown in FIG. 4, to a position proximate one of the opposing sides 50 of the patient support surface 44. Positioning the ambulation device 34 near one of the opposing sides 50 improves the likelihood of a successful patient transfer in a manner to be described to promote early patient mobility.

The patient may be supported on the patient support surface 44 in the supine position. The ambulation device 34 is moved from the coupled configuration to the decoupled configuration in the exemplary manner previously described. With the ambulation device 34 decoupled from the patient support apparatus 32, the barrier 74 is no longer positioned adjacent to one of the opposing sides 50 of the patient support surface 44, and thereby no longer obstructs or prevents egress of the patient from the patient support apparatus 32. The ambulation device 34 is configured in a suitable manner to the patient; i.e., the distance between the barriers 74, 76 and the height of the grips 78 are selectively adjusted. The ambulation device 34 is moved along the floor surface 37 to a position proximate one of the opposing sides 50 of the patient support surface 44.

The lift device 56 may be operated to lower the patient support surface 44 relative to the base 36 between the first and second positions. For example, the second position may be closer to the floor surface 37 relative to the first position. If necessary, one of the side rails 62 may be moved from a raised position to a lowered position.

The patient is moved from the supine position to an upright position with legs extending to the floor surface 37. The ambulation device 34 is positioned proximate one of the opposing sides 50 of the patient support surface 44 with the barriers 74, 76 positioned on opposite sides of the patient. With the patient in a seated position on one of the opposing sides 50 of the patient support surface 44, the patient may be support or otherwise guarded from falling on all four sides; i.e., forwardly by the cross member 82, laterally by the barriers 74, 76, and rearwardly by the patient support apparatus 32.

The ambulation device 34 may be positioned such that the feet of the patient resting upon the floor surface are positioned within the walking area 86 (see FIG. 7). In certain embodiments, the trailing arms 94 of the barriers 74, 76 are positioned beneath the patient support deck 54 (and/or the base 36) to provide a more tightly confined walking area and position the grips 78 more closely to the patient. The brake mechanism of the ambulation device 34 may be engaged to prevent inadvertent movement of the wheels 88 along the floor surface 37. With the grips 78 being grasped by the hands of the patient, and perhaps with the aid of a caregiver, the patient is transferred from the seated to the standing position from one of the opposing sides 50 of the patient support apparatus 32. The resulting arrangement is shown, for example, in FIG. 5. In certain embodiments, the ambulation device 34 operates as a conventional walker thereafter. The ambulation device 34 supports the patient during ambulation away from the patient support apparatus 32. With the advantageous features of the patient mobility system 30, the likelihood of accidental falling episodes may be drastically reduced, thereby instilling confidence in caregivers and patients alike to attempt ambulation earlier than otherwise would be considered. The benefits of early patient mobility to patient recovery are well established.

The patient mobility system 30 of the present disclosure may also assist with patient transfers from the standing to the seated positions. The ambulation device 34 supports the patient during ambulation as the patient approaches the patient support apparatus 32. Once the patient is sufficiently proximate to the patient support apparatus 32, brakes of the ambulation device 34 may be engaged to prevent inadvertent movement of the wheels 88 along the floor surface 37. The patient may use the ambulation device 34 for stability as the patient moves from the standing position to the seated position on the patient support surface 44.

Once safely in the seated position on the patient support surface, the ambulation device 34 may be moved along the floor surface 37 from the position proximate one of the opposing sides 50 of the patient support surface 44 to proximate the foot end 48 of the patient support apparatus 32, as shown in FIG. 4. The movement may be autonomous, semi-autonomous, or dependent upon a manual force provided by a user.

In certain embodiments, the patient mobility system 30 facilitates a patient transfer at the foot end 48 of the patient support surface 44. For example, the patient support apparatus 32 may not comprise the footboard 60, or the footboard 60 is lowered or removed from the patient support apparatus 32 so as to permit patient egress from the foot end 48 of the patient support surface 44. In another exemplary embodiment, the footboard 60 may comprise a functional component of the ambulation device 34. The patient mobility system 30 is moved from the coupled configuration to the decoupled configuration in the exemplary manner previously described. Subsequent to moving to the decoupled configuration, the ambulation device 34 is positioned proximate the foot end 48 of the patient support apparatus 32, as shown, for example, in FIG. 4. The ambulation device 34 may be positioned such that the patient walking area 86 is adapted to receive the patient during the patient transfer at the foot end 48 of the patient support surface 44. The brake mechanism of the ambulation device 34 may be engaged to prevent inadvertent movement of the wheels 88 along the floor surface 37.

The patient support surface 44 may be manipulated to facilitate patient egress at the foot end 48 of the patient support surface 44. In one embodiment, the actuators are actuated to move the articulating sections 66*a*, 66*b*, 66*c* between the bed configuration and a chair configuration. The lift device 56 may also be actuated to move the patient support surface 44. Exemplary systems and methods of moving articulating sections from the bed configuration to the chair configuration are described in commonly owned U.S. Patent Application Publication No. 2017/0079434, the entire contents of which are hereby incorporated by reference.

With the patient support surface 44 of the patient support apparatus 32 in the chair configuration and the ambulation device 34 suitably positioned proximate the foot end 48, the patient transfer is executed and the ambulation device 34 provides support to the patient during ambulation away from the patient support apparatus 32. It is to be understood that the patient support surface 44 may be moved to the chair configuration with the patient support apparatus 32 and the ambulation device 34 in the coupled and/or the decoupled configuration. In other words, in one example the patient support surface 44 may be moved to the chair configuration and subsequently the ambulation device 34 is decoupled from the patient support apparatus in the exemplary manner previously described.

Should it be desired to move the patient mobility system 30 from the decoupled configuration in which the patient support apparatus 32 and the ambulation device 34 are decoupled, to the coupled configuration in which the patient support apparatus 32 and the ambulation device 34 are coupled, the stages of decoupling previously described may be performed in reverse. With the ambulation device 34 positioned proximate the foot end 48 of the patient support apparatus 32, the length of the cross member 82 adjusted to alter the distance between the barriers 74, 76 in the exemplary manner previously described. For example, the segments 84 of the cross member 82 telescope relative outwardly to correspond to a distance between the guide rails 122 disposed on the opposing sides 50 of the patient support surface 44. Further, the trailing arm 94 pivotally coupled to the leading arm 92 is pivoted to adjust a height of the linkage 104 relative to the floor surface 37. More specifically, the trailing arm 94 and/or the leading arm 92 is pivoted relative to one another to position the third link arm 110 at a height corresponding to the guide rail 122 of the rail system 120. Additionally or alternatively, the lift device 56 may be operated to move the patient support surface 44 relative to the base 36 to correspondingly adjust the height of the guide rail 122 to the height of the third link arm 110. Sensors 154 may be provided in communication with a controller 152 to be described to achieve the position and/or alignment.

With the third link arm 110 and the guide rail 122 aligned, the wheels 88 of the ambulation device 34 engaging the floor surface 37, the ambulation device 34 is moved along the floor surface 37 until the ambulation device 34 is coupled with the rail system 120. The ambulation device 34 moves in the direction opposite of arrow 134 (FIG. 10) until third link arm 110 of the linkage 104 is within the guide rail 122 of the rail system 120. Moving the ambulation device 34 along the floor surface 37 may be facilitated by the actuators associated with one or more of the wheels 88, or by the user applying a manual force to the ambulation device 34. With the coupling of the patient support apparatus 32 and the ambulation device 34, the barrier 74 comprising the articulating members 90 may be positioned adjacent one of the opposing sides 50 and at least partially extend above the patient support surface 44, thereby obstructing or preventing egress of the patient from the patient support apparatus 32 and defining the coupling configuration. As previously described, the barrier 74 comprising the articulating members 90 may be raised and lowered to obstruct or permit, respectively, egress of the patient from the patient support apparatus 32.

The wheels 88 associated with each of the leading arm 92 and the trailing arm 94 disengage the floor surface 37. One of more of the actuators A associated with one or both of the third pivot 116 and the fourth pivot 118 are actuated such that the first link arm 106 and the second link arm 108 pivot about the third and fourth pivots 116, 118, respectively, in the direction opposite of arrow 132 (FIG. 8). With the wheels 88 of the ambulation device 34 supported off of the floor surface 37, the articulating members 90 may be considered to have moved from the deployed configuration to the barrier configuration. The articulating members 90 of the barrier 74 may remain at least partially above the patient support surface 44, thereby obstructing or preventing egress of the patient from the patient support apparatus 32. The trailing arm 94 is pivoted relative to the leading arm 92 in a direction opposite of arrow 130 (FIG. 3), resulting in an exemplary configuration as shown in FIG. 2. The stages of coupling above have been described with reference to the barrier 74 comprising the articulating members 90. It is to be understood that the stages of coupling are applicable to the pair of barriers 74, 76 each comprising articulating members 90. In certain embodiments, the articulating members 90 associated with each of the barriers 74, 76 are configured to articulate in unison or independently between the barrier configuration and the deployed configuration.

The ambulation device 34 may comprise the barrier 74 or the pair of barriers 74, 76 as previously described. FIG. 11A shows the ambulation device 34' in accordance with another exemplary embodiment of the present disclosure with the ambulation device 34' comprising a singular barrier 74'. In many respects the ambulation device 34' of FIG. 11A is similar to that previously described. In particular, the barrier 74' may comprise the articulating members 90 and the linkage 104. The ambulation device 34' comprises the handle 80 defining the grip 78, and wheels 88 coupled to the articulating members 90. The articulating members 90 of the barrier 74' comprises the leading arm 92 pivotally coupled with the trailing arm 94, and the linkage 104 comprises the first link arm 106, second link arm 108, and the third link arm 110. The ambulation device 34' and the patient support apparatus 32 moves between the coupled configuration and the decoupled configuration as previously described with at least one variation to be described.

The ambulation device 34' further comprises a stability system 136 adapted to stabilize the singular barrier 74' in the decoupled configuration. The stability system 136 comprises a stability arm 138 pivotally coupled to the barrier 74' of the ambulation device 34'. FIG. 11A shows the stability arm 138 pivotally coupled to the leading arm 92 of the articulating members 90.

The stability system 136 is adapted to be moved from an inoperative position in which the stability arm 138 provides no support or stability to the barrier 74', and an operative position (shown in phantom) in which the stability arm 138 provides support or stability to the barrier 74'. Moving between the inoperative and operative positions may be facilitated by actuators (not shown) associated with a pivot 140, or by the user applying a manual force to the stability arm 138. The stability arm 138 may be maintained in the inoperative position by the actuator(s) or by a latching mechanism of the stability system 136. The stability arm 138 is shown with a generally arcuate shape, but any suitable construction is contemplated. The stability arm 138 may also comprise telescoping functionality to move between a retracted configuration and an extended configuration.

The stability arm 138 is of a suitable length so as to provide support and stability to the barrier 74' when the ambulation device 34' is away from the patient support apparatus 32. FIG. 11A shows that in the operative position, the stability arm 138 is oriented substantially perpendicular to the barrier 74' and substantially parallel to the floor surface such that the ambulation device 34' is supported at three points in a generally triangular arrangement.

The stability system 136 further comprises one or more wheels 142 configured to facilitate transport over the floor surface 37. FIG. 11A shows one wheel coupled to the stability arm 136 opposite the pivot 140. The wheel(s) 142 may be casters configured to rotate and swivel relative to the stability arm 138, or non-steerable, steerable, non-powered, powered, or combinations thereof.

In certain embodiments, the stability system 136 may be operated once the wheels 88 associated with each of the leading arm 92 and the trailing arm 94 engage the floor surface 37. The operation of the stability system 136 may occur prior to the ambulation device 34' decoupling from the patient support apparatus 32. For example, with the third link arm 110 of the barrier 74' supported by the guide rail 122 of the rail system 120, as shown in FIG. 9, the stability arm 138 may be moved from the inoperative position to the operative position. More specifically, the stability arm 138 is moved in the direction of arrow 135 such that the stability arm 138 moves away from the barrier 74'. The stability arm 138 may generally move in a plane substantially perpendicular to a plane defining the barrier 74'. A length of the stability arm 138 may be adjusted as needed, such as through the telescoping functionality. The stability arm 138 is in the operative position such that the wheel 142 of the stability system 136 engages the floor surface to provide the three-point triangular support shown in FIG. 11A. The ambulation device 34' may remain coupled to the patient support apparatus 32 at this point. It is to be understood that in other embodiments, the stability system 136 may be operated prior to the articulating members 90 moving from the barrier configuration the deployed configuration.

With the stability system 136 in the operative position, the barrier 74' may be moved so as to decouple the ambulation device 34' from the patient support apparatus 32. With concurrent reference to FIG. 10, the ambulation device 34' is moved in the direction of arrow 134 until third link arm 110 of the linkage 104 slidably disengages from within the guide rail 122 of the rail system 120. The wheels 88 of the barrier 74' and the wheel(s) 142 of the stability system 136 engage the floor surface 37 as the patient mobility system 30 is moved from the coupled to the decoupled configuration. Once the patient support apparatus 32 and the ambulation device 34' are decoupled defining the decoupled configuration, the ambulation device 34' is configured to provide support to the patient during ambulation away from the patient support apparatus 32. Therefore, the ambulation device 34' of the exemplary embodiment of FIG. 11A is a functional component of the patient mobility system 30 in the coupled and decoupled configurations.

FIG. 11B shows the ambulation device 34' further comprising the stability system 136 in accordance with another exemplary embodiment of the present disclosure. In many respects not specifically described, the stability system 136 of FIG. 11B is similar to that of FIG. 11A. The stability system 136 of FIG. 11B comprises the stability arm 138 adapted to stabilize the singular barrier 74' in the decoupled configuration with the stability arm 138 pivotally coupled to the cross member 82 of the ambulation device 34', for example, about the pivot 140. The stability system 136 is adapted to be moved from the inoperative position in which the stability arm 138 provides no support or stability to the barrier 74', and the operative position (shown in phantom) in which the stability arm 138 provides support or stability to the barrier 74'. FIG. 11B shows that in the operative position, the stability arm 138 is oriented parallel to the barrier 74', substantially perpendicular to the cross member 82, and substantially perpendicular to the floor surface such that the ambulation device 34' is supported at three points in a generally triangular arrangement. In certain embodiments, the stability arm 138 of FIG. 11B may be moved in the direction of arrow 135 from the inoperative position to the operative position. More specifically, the stability arm 138 is moved in the direction of arrow 135 such that the stability arm 138 moves away from the cross member 82 to a generally vertical orientation such that the wheel 142 of the stability system 136 engages the floor surface to provide the three-point triangular support shown in FIG. 11B.

The advantageous features of the patient mobility system 30 described throughout the present disclosure may be executed in any number of ways. In certain embodiments, the patient mobility system 30 comprises a user input device 150 adapted to be actuated by a user to execute, for example, moving the patient support surface 44 relative to the base 36 between the first and second positions, articulating the articulating sections 66*a*, 66*b*, 66*c*, moving the barrier 74 between the raised and lowered positions, moving the patient mobility system 30 between the coupled and decoupled configurations, moving the patient mobility system 30 along the floor surface 37, and the like. It is understood that any electronically controllable feature of the patient mobility system 30 may be executed from the user input device 150.

Figure 12:
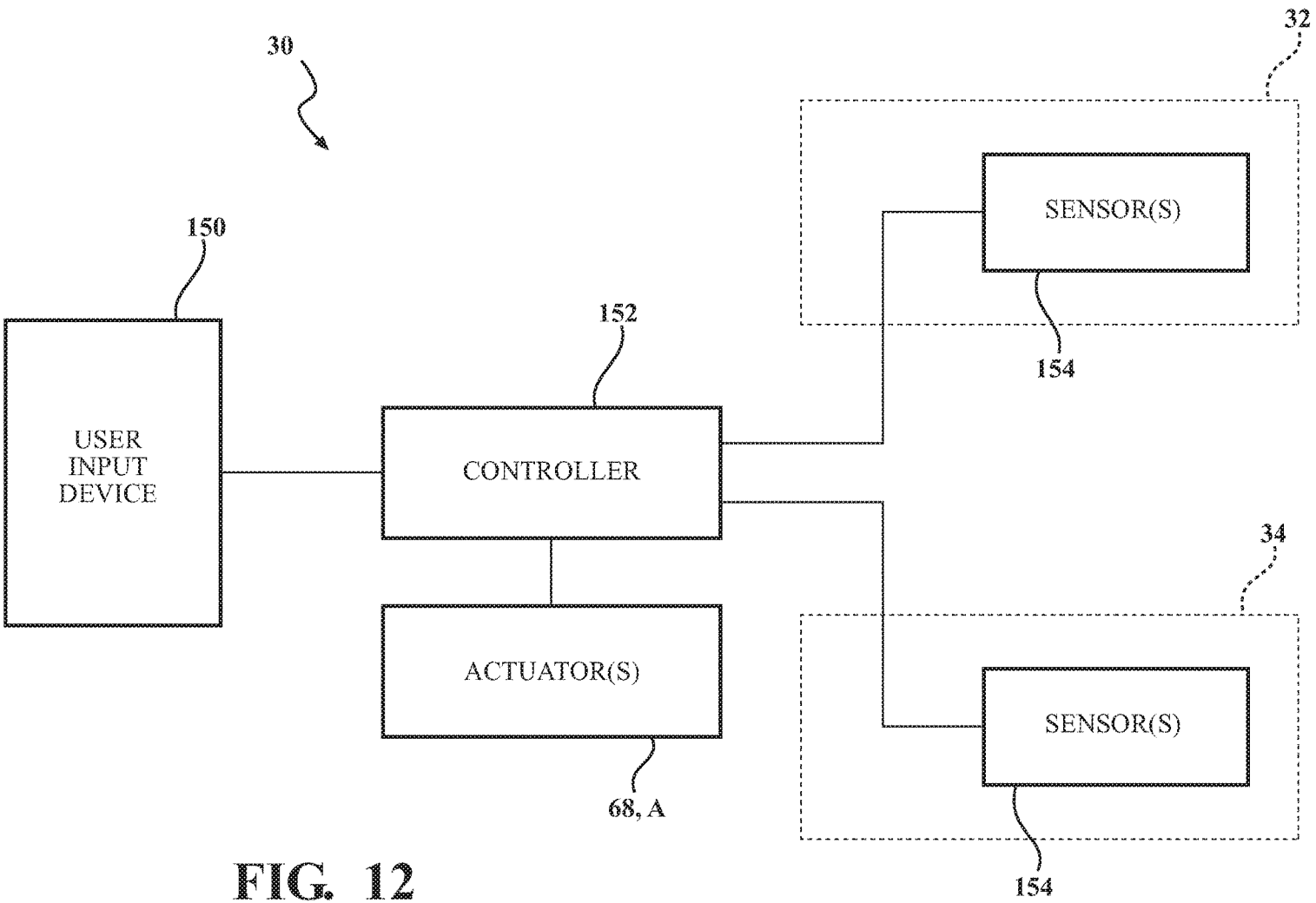
FIG. 12 is a schematic diagram of the patient mobility system in accordance with another exemplary embodiment of the present disclosure.

With reference to FIG. 12, an input is provided to the controller 152 typically through the user input device 150 in electronic communication with the controller 152. The user input device 150 may comprise tactile buttons and/or touchscreen features, a voice recognition system, a graphic user interface (GUI), and/or or any other suitable interface to receive input of the user. The user input device 150 may be coupled to the patient support apparatus 32 and/or the ambulation device 34 at a suitable location easily accessible by a caregiver, and/or disposed on a remote device such as a handheld device usable by the patient while resting upon the patient support apparatus 32.

Sensors 154 may be provided in communication with the controller 152 to facilitate execution of the features of the patient mobility system 30. In certain embodiments, the sensors 154 provide positional information of the ambulation device 34 relative to the patient support apparatus 32, such as moving from the decoupled configuration to the coupled configuration. The sensors 154 may be coupled to the barrier 74 to provide positional information of, for example, the linkage 104 during the stages of decoupling and coupling. The controller 152 receives signals from the sensors 154 to control the actuators accordingly. It is understood that additional electronic system and subsystems may be provided in communication with the controller 152 to execute the features of the patient mobility system 30 described throughout the present disclosure.

It is to be appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient mobility system for early ambulation of a patient, said patient mobility system comprising:

a patient support apparatus comprising a base adapted to rest upon a floor surface, and a patient support surface supported by said base and comprising a head end, a foot end, and opposing sides separating said head end and said foot end; and an ambulation device removably coupled to said patient support apparatus and comprising a barrier configured to prevent egress of the patient by being adjacent to one of said opposing sides of said patient support surface and having a height sufficient to at least partially extend above said patient support surface when said ambulation device and said patient support apparatus are coupled defining a coupled configuration, and said ambulation device configured to engage the floor surface and provide support to the patient during ambulation away from said patient support apparatus when said ambulation device and said patient support apparatus are decoupled defining a decoupled configuration.

2. The patient mobility system of claim 1, wherein patient support apparatus is adapted to support said ambulation device off the floor surface in said coupled configuration.

3. The patient mobility system of claim 1, wherein said ambulation device further comprises wheels coupled to said barrier and said barrier comprises a plurality of articulating members configured to articulate between a barrier configuration to prevent egress of the patient in said coupled configuration, and a deployed configuration with said wheels engaging the floor surface in said decoupled configuration.

4. The patient mobility system of claim 3, wherein said plurality of articulating members further comprise a leading arm with one of said wheels coupled to said leading arm, a trailing arm with another one of said wheels coupled to said trailing arm with said trailing arm pivotally coupled to said leading arm.

5. The patient mobility system of claim 1, further comprising a rail system slidably coupling said patient support apparatus and said ambulation device with said rail system comprising a guide rail coupled to said patient support apparatus for supporting said ambulation device in said coupled configuration.

6. The patient mobility system of claim 1, further comprising a second barrier being adjacent to the other of said opposing sides of said patient support surface with a height sufficient to at least partially extend above said patient support surface in said coupled configuration.

7. The patient mobility system of claim 1, wherein said patient support apparatus further comprises a lift device for moving said patient support surface relative to said base between a first position and a second position with said height of said barrier at least partially extending above said patient support surface in both said first and second positions in said coupled configuration.

8. The patient mobility system of claim 1, wherein, when in said coupled configuration, said barrier is movable between a raised position at least partially extending above said patient support surface for preventing egress of the patient and a lowered position for permitting egress of the patient.

9. A patient mobility system for early ambulation of a patient, said patient mobility system comprising:

a patient support apparatus comprising a base adapted to rest upon a floor surface, and a patient support surface supported by said base and comprising a head end, a foot end, and opposing sides separating said head end and said foot end; and an ambulation device removably coupled to said patient support apparatus and comprising a pair of barriers adjacent to said opposing sides of said patient support surface and having a height sufficient to at least partially extend above said patient support surface to prevent egress of the patient when said ambulation device and said patient support apparatus are coupled defining a coupled configuration, and said pair of barriers configured to provide support to the patient during ambulation away from said patient support apparatus when said ambulation device and said patient support apparatus are decoupled defining a decoupled configuration.

10. The patient mobility system of claim 9, wherein said ambulation device further comprises wheels coupled to each of said pair of barriers with said wheels adapted to be supported off of the floor surface in said coupled configuration, and engaging the floor surface to support the ambulation device in said decoupled configuration.

11. The patient mobility system of claim 9, wherein each of said pair of barriers further comprises a handle with said handles coupled to said pair of barriers to form grips for providing support to the patient during ambulation away from said patient support apparatus.

12. The patient mobility system of claim 9, wherein said ambulation device further comprises a cross member coupling said pair of barriers.

13. The patient mobility system of claim 12, wherein said cross member comprises a length defined between said pair of barriers with said length being adjustable to selectively alter distance between said pair of barriers.

14. The patient mobility system of claim 12, wherein said pair of barriers and said cross member cooperate to define a walking area of the floor surface for positioning the patient during ambulation away from said patient support apparatus.

15. The patient mobility system of claim 9, further comprising a rail system slidably coupling said patient support apparatus and said ambulation device with said rail system comprising guide rails coupled to said patient support apparatus proximate said opposing sides of said patient support surface with said guide rails configured to support said pair of barriers in said coupled configuration.

16. The patient mobility system of claim 15, wherein said ambulation device further comprises a cross member coupling said pair of barriers with said cross member extending between said guide rails in said coupled configuration.

17. The patient mobility system of claim 9, wherein each of said barriers comprises a plurality of articulating members configured to articulate between a barrier configuration to prevent egress of the patient and a deployed configuration with said wheels engaging the floor surface for supporting the patient during ambulation away from said patient support apparatus.

18. A patient mobility system for early ambulation of a patient, said patient mobility system comprising:

a patient support apparatus comprising a base adapted to rest upon a floor surface, and a patient support surface supported by said base and comprising a head end, a foot end, and opposing sides separating said head end and said foot end; and an ambulation device removably coupled to said patient support apparatus and comprising wheels and a plurality of articulating members configured to articulate between a barrier configuration preventing egress of the patient by being adjacent to one of said opposing sides of said patient support surface and having a height sufficient to at least partially extend above said patient support surface, and a deployed configuration with said wheels engaging the floor surface for supporting the patient during ambulation away from said patient support apparatus.

19. The patient mobility system of claim 18, wherein said plurality of articulating members comprises a leading arm with one of said wheels coupled to said leading arm, a trailing arm with another one of said wheels coupled to said trailing arm with said trailing arm pivotally coupled to said leading arm.

20. The patient mobility system of claim 19, wherein said plurality of articulating members further comprises an actuator pivotally coupling said leading arm and said trailing arm.

* * * * *